US008829819B1

(12) United States Patent
Angeles et al.

(10) Patent No.: US 8,829,819 B1
(45) Date of Patent: Sep. 9, 2014

(54) ENHANCED ACTIVE PRELOAD FOR HIGH PERFORMANCE LED DRIVER WITH EXTENDED DIMMING

(71) Applicant: Power Integrations, Inc., San Jose, CA (US)

(72) Inventors: Christian P. Angeles, San Jose, CA (US); Marvin C. Espino, San Jose, CA (US); Jose R. Del Carmen, Jr., San Jose, CA (US); Chunming Guo, Shenzhen (CN)

(73) Assignee: Power Integrations, Inc., San Jose, CA (US)

( * ) Notice: Subject to any disclaimer, the term of this patent is extended or adjusted under 35 U.S.C. 154(b) by 0 days.

(21) Appl. No.: 13/889,193

(22) Filed: May 7, 2013

(51) Int. Cl.
*H05B 37/02* (2006.01)
*H05B 33/08* (2006.01)

(52) U.S. Cl.
CPC ..... *H05B 33/0815* (2013.01)
USPC ..... 315/308; 315/219; 315/224

(58) Field of Classification Search
CPC ..... H05B 37/00; H05B 37/02; H05B 33/00; H05B 33/02; H05B 33/08; H05B 33/0803; H05B 33/0806; H05B 33/0815; H05B 33/0824; H05B 33/0839; H05B 33/0842
USPC ..... 315/291, 307, 308, 219, 224
See application file for complete search history.

(56) References Cited

U.S. PATENT DOCUMENTS

| | | | | |
|---|---|---|---|---|
| 6,963,175 | B2 | 11/2005 | Archenhold et al. | |
| 8,384,295 | B2 * | 2/2013 | Simi | 315/219 |
| 2008/0258647 | A1 * | 10/2008 | Scianna | 315/291 |
| 2010/0134038 | A1 * | 6/2010 | Shackle et al. | 315/291 |
| 2011/0241557 | A1 | 10/2011 | Grotkowski et al. | |
| 2012/0286679 | A1 | 11/2012 | Liu | |
| 2013/0049622 | A1 | 2/2013 | Angeles | |

OTHER PUBLICATIONS

Notice of Allowance received for U.S. Appl. No. 13/223,080, mailed on Feb. 19, 2014, 8 pages.
Del Carmen, Jr., et al., Unpublished U.S. Appl. No. 13/844,356, filed on Mar. 15, 2013, titled "Lossless Preload for Led Driver with Extended Dimming", 26 pages.

* cited by examiner

*Primary Examiner* — David H Vu
(74) *Attorney, Agent, or Firm* — Morrison & Foerster LLP

(57) ABSTRACT

Enhanced active preload circuits for an LED driver implementing phase-angle dimming are disclosed. The enhanced active preload circuits may be used with any type of phase-angle control dimmer that either controls the leading edge or trailing edge of the line voltage cycle. In one example, the enhanced active preload circuitry may be used with an isolated or non-isolated LED driver converter having a Triac leading edge phase-angle control dimmer by directly sensing (e.g., by sensing the dimming level using an output/load voltage signal or output/load current signal) or indirectly sensing (e.g., by sensing a signal of output or bias winding) the Triac conduction angle. The enhanced active preload circuitry may advantageously improve performance of the LED driver by extending the dimming ratio at deep dimming and by adjusting the preload sinking current in response to a preload control signal.

20 Claims, 14 Drawing Sheets

400

500

Enhanced Active Preload Responsive to Load Voltage
To Load
From Input Circuitry
Controller
CLAMP
Ref
FB
BP
R
S1
Q2
U2
D1
L1
C1
Co1
Co2
505
501
507
509
502

709

705

800

ENHANCED ACTIVE PRELOAD FOR HIGH PERFORMANCE LED DRIVER WITH EXTENDED DIMMING

BACKGROUND

1. Field

The present disclosure relates generally to circuits for driving light-emitting diodes (LEDs) and, more specifically, to LED driver circuits having phase-angle dimming circuitry.

2. Discussion of the Related Art

LED lighting has become popular in the industry due to the many advantages that this technology provides. For example, LED lamps typically have a longer lifespan, pose fewer hazards, and provide increased visual appeal when compared to other lighting technologies, such as compact fluorescent lamp (CFL) or incandescent lighting technologies. The advantages provided by LED lighting have resulted in LEDs being incorporated into a variety of lighting technologies, televisions, monitors, and other applications.

One known technique that has been used for dimming is the use of a Triac circuit for analog LED dimming or phase angle dimming. A Triac circuit operates by delaying the beginning of each half-cycle of alternating current (ac) power, which is known as "phase control." By delaying the beginning of each half-cycle, the amount of power delivered to the load (e.g., the lamp) is reduced, producing a dimming effect in the light output by the lamp. In most applications, the delay in the beginning of each half-cycle is not noticeable to the human eye because the variations in the phase controlled line voltage and the variations in power delivered to the lamp occur so quickly. For example, Triac dimming circuits work especially well when used to dim incandescent light bulbs since the variations in phase angle with altered ac line voltages are immaterial to these types of bulbs. However, flicker may be noticed when Triac circuits are used for dimming LED lamps.

Flickering in LED lamps can occur because these devices are typically driven by LED drivers having regulated power supplies that provide regulated current and voltage to the LED lamps from ac power lines. Unless the regulated power supplies that drive the LED lamps are designed to recognize and respond to the voltage signals from Triac dimming circuits in a desirable way, the Triac dimming circuits are likely to produce non-ideal results, such as limited dimming range, flickering, blinking, and/or color shifting in the LED lamps.

The difficulty in using Triac dimming circuits with LED lamps is in part due to a characteristic of the Triac itself. Specifically, a Triac is a semiconductor component that behaves as a controlled ac switch. Thus, the Triac behaves as an open switch to an ac voltage until it receives a trigger signal at a control terminal, causing the switch to close. The switch remains closed as long as the current through the switch is above a value referred to as the "holding current." Most incandescent lamps draw more than the minimum holding current from the ac power source to enable reliable and consistent operation of a Triac. However, the comparably low currents drawn by LEDs from efficient power supplies may not meet the minimum holding currents required to keep the Triac switches conducting for reliable operation. As a result, the Triac may trigger inconsistently. In addition, due to the inrush current charging the input capacitance and because of the relatively large impedance that the LEDs present to the input line, a significant ringing may occur whenever the Triac turns on. This ringing may cause even more undesirable behavior as the Triac current may fall to zero and turn off the string of LEDs, resulting in a flickering effect.

To address these issues, conventional LED driver designs typically rely on current drawn by a dummy load or "bleeder circuit" of the power converter to supplement the current drawn by the LEDs in order to draw a sufficient amount of current to keep the Triac conducting reliably after it is triggered. These bleeder circuits typically include passive components and/or active components controlled by the converter parameters or by the load level. While useful to draw additional current, a bleeder circuit that is external to the integrated circuit requires the use of extra components with associated penalties in cost and efficiency.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

Various embodiments directed to the enhanced active preload circuitry for an LED driver implementing phase-angle dimming are disclosed. The enhanced active preload circuitry disclosed in this application may be used with any type of phase-angle control dimmer that either controls the leading edge or trailing edge of the line voltage cycle. In a more specific example, the enhanced active preload circuitry may be used with an isolated or non-isolated LED driver converter having a Triac leading edge phase-angle control dimmer by directly sensing (e.g., by sensing the dimming level using an output/load voltage signal or output/load current signal) or indirectly sensing (e.g., by sensing a signal of output or bias winding) the Triac conduction angle. The enhanced active preload circuitry provides improved performance for an extended dimming ratio at deep dimming and high efficiency at normal (no dim) operation of the LED driver.

It should be appreciated that while some of the examples provided below refer to Triac dimmers with leading-edge phase-angle control, the enhanced active preload circuitry may be similarly used with any other phase-angle control dimmer applications.

Figure 1:
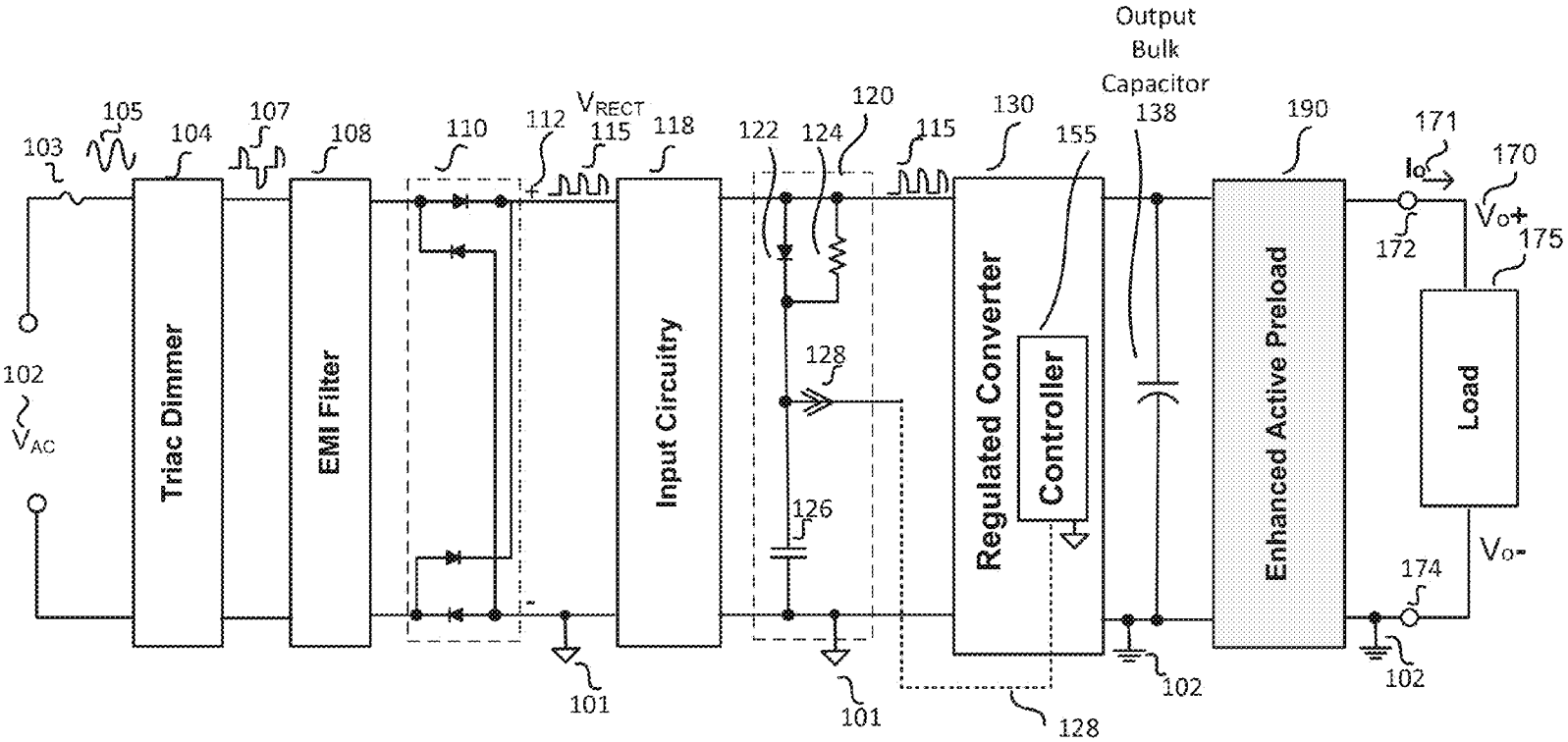
FIG. 1 shows a general block diagram of an offline LED driver with Triac phase control dimming according to various examples.

FIG. 1 shows a block diagram of an example LED driver 100 including a regulated converter 130 and a Triac dimming circuit 104. As shown, Triac dimming circuit 104 is coupled to receive full sinusoidal waveform 105 of input ac line signal $V_{AC}$ 102 from the input terminal through a fusible protection device 103. Traic dimming circuit 104 applies leading-edge phase control by delaying the beginning of each half-cycle of input ac line signal $V_{AC}$ 102, to produce a leading-edge phase controlled Triac signal 107. By delaying the beginning of each half-cycle of the input ac line signal $V_{AC}$ 102, the amount of power delivered to the load 175 (e.g., a lamp) is reduced and the light output of the LED appears dimmed. The LED driver may further include rectifier bridge 110 coupled to receive Triac signal 107 through electromagnetic interference (EMI) filter 108. As shown in the depicted example, the rectified voltage $V_{RECT}$ 112 (represented by symbolic waveform 115) produced by the rectifier bridge 110 has a conduction phase angle in each half line cycle that is controlled by Triac circuit 104.

The rectified voltage $V_{RECT}$ 112 provides a rectified leading-edge phase controlled voltage to a high frequency regulated converter 130 through required or optional input circuitry 118 that may include interface devices/blocks, such as an input bleeder, a damper, an inductive and capacitive filter, and/or other components depending on the application. It should be appreciated that regulated converter 130 may be an isolated or non-isolated converter with the same or shifted input/output reference grounds (e.g., reference grounds 101 and 102 may be either directly coupled or shifted relative to each other). Non-limiting examples of isolated converters include Flyback and forward converters, and non-limiting examples of non-isolated converters include Buck and Tapped Buck converters.

LED driver 100 may further include peak detection circuit 120 cascaded at the interface between input circuitry 118 and regulated converter 130 to output input voltage signal 128, which may be representative of the leading edge peak of the rectified phase controlled input voltage $V_{RECT}$ 112. As discussed in greater detail below, input voltage signal 128 may be utilized in converter 130 for dimming control and for under/over voltage protection. In one example, peak detection circuit 120 includes capacitance 126 that may be charged via rectifier (e.g., a diode) 122 to the leading edge peak of the rectified phase controlled input voltage $V_{RECT}$ 112. Resistor 124 provides a discharge path for capacitance 126 with a long time constant (to prevent any modulation of line frequency current at controller terminal). Input voltage signal 128 may provide information regarding the phase controlled input voltage to controller 155 (e.g., fed as a current to controller via a resistor) for monitoring the voltage level of input ac line signal $V_{AC}$ 102 and implementing over-voltage and under-voltage protection.

The rectified voltage $V_{RECT}$ 112, which may be unaffected or at least substantially unaffected by input circuitry 118 and peak detection circuit 120, may be applied to the input terminal of converter 130 and provided to controller 155. In one example, controller 155 may be referenced to the input ground 101 (primary control). The regulated output of converter 130 across the bulk capacitor 138, before applying output voltage Vo, 170 and output current Io, 171 to load 175 at terminals 172 and 174, may be coupled to the interface of enhanced active preload circuit 190. Enhanced active preload circuit 190 may receive a control signal by directly or indirectly sensing the input voltage phase angle to sink a current that is inversely proportional to the phase controlled input voltage 107.

In some examples, enhanced active preload circuit 190 may either be referenced only to the secondary ground or referenced only to the input ground, obviating the need for additional components and provisions for level shift adjustment of input/output reference ground levels. Example enhanced active preload circuits are shown in FIGS. 4A, 5A, 6A, 7A, 7B, and 8A. Example converters in which the example enhanced active preload circuits may be used are shown in FIGS. 2 and 3, with specific implementations of the enhanced active preload circuits in these converters shown in FIGS. 4B, 5B, 6B, 7C, and 8B.

Figure 2:
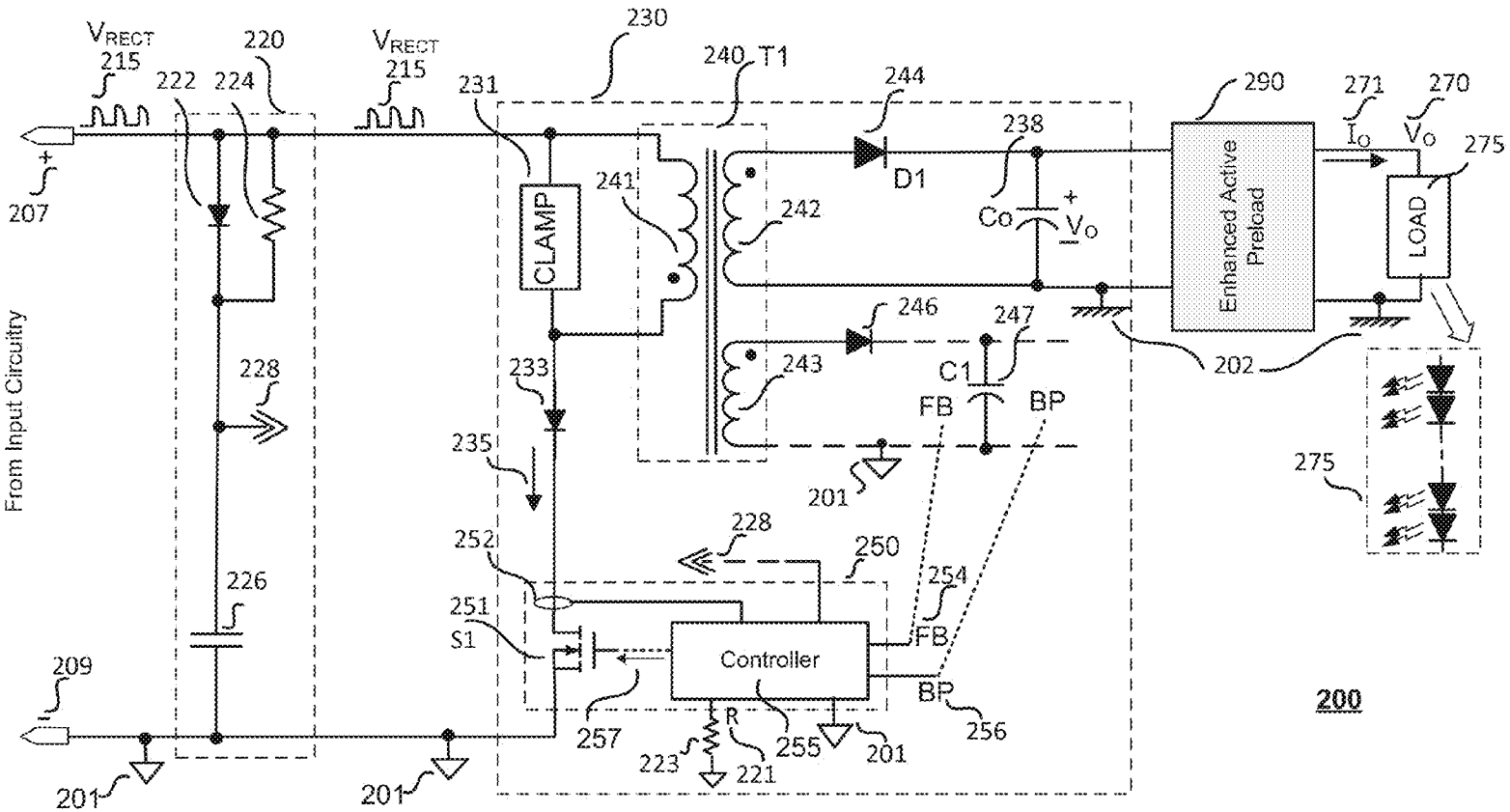
FIG. 2 is a schematic illustrating an example isolated Flyback LED driver converter implementing input line phase control dimming and having an enhanced active preload at the output.
Figure 3:
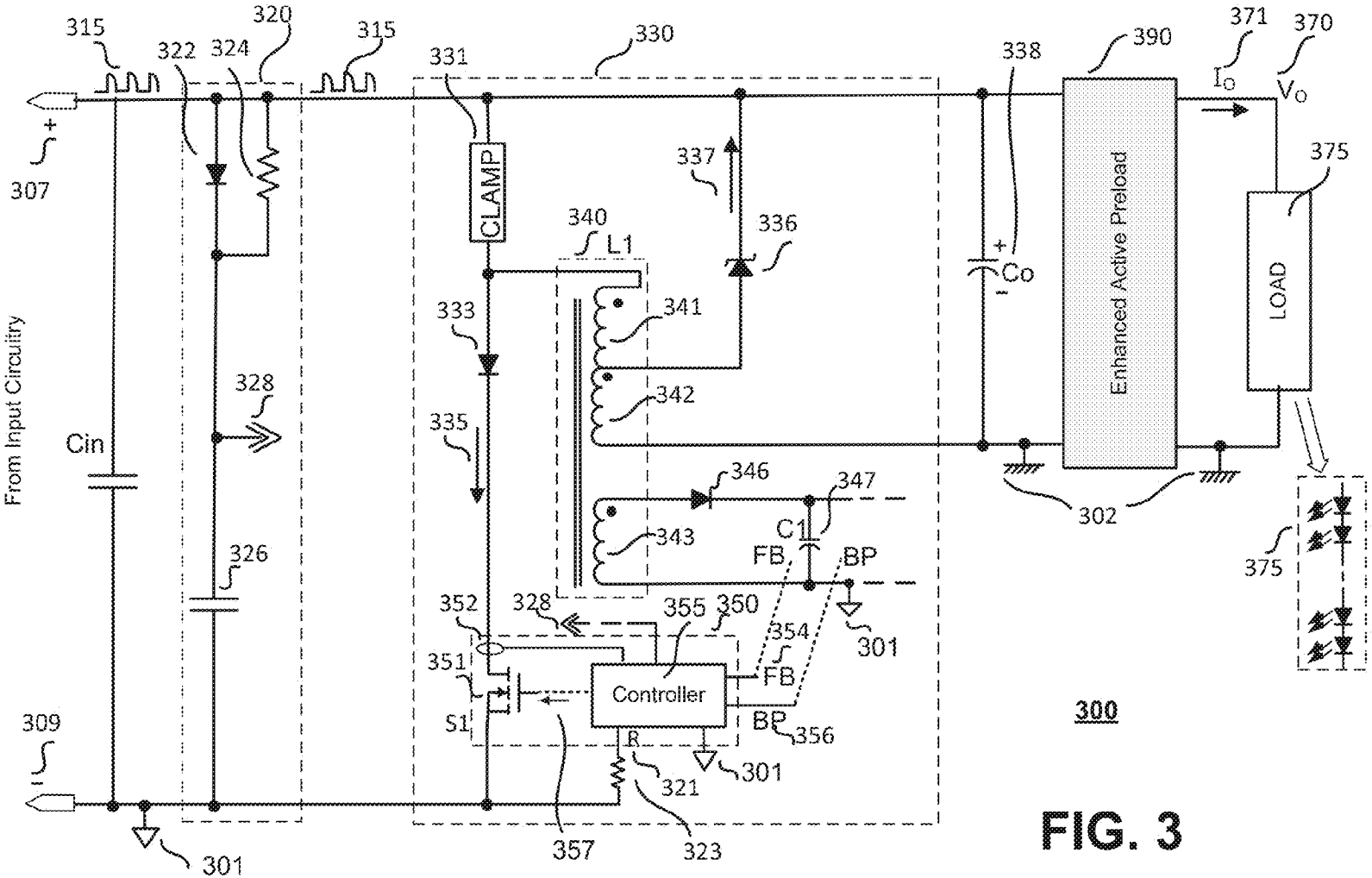
FIG. 3 is a schematic illustrating an example non-isolated Tapped Buck LED driver converter implementing input line phase control dimming and having an enhanced active preload at the output.

FIG. 2 is a schematic illustrating an example isolated Flyback LED driver converter 200 implementing input line phase control dimming and having an enhanced active preload circuit 290 coupled at its output. Example preload circuits that may be used for enhanced active preload circuit 290 are described below with respect to FIGS. 4A, 5A, 6A, 7A, 7B, and 8A. A rectified leading edge phase controlled input voltage (represented by waveform $V_{RECT}$ 215 referenced to input ground 201) may be applied at input terminals 207/209. In one example, the rectified leading edge phase controlled input voltage may be rectified leading edge phase controlled input voltage 115 provided from Triac dimmer 104 and rectifier bridge 110 through the input circuitry 118, as shown in FIG. 1.

Flyback LED driver converter 200 may further include peak detection circuit 220, which may be the same as peak detection circuit 120 in FIG. 1. In one example, peak detection circuit 220 may include rectifier 222, resistor 224, and capacitor 226. As described above with respect to FIG. 1, peak detection circuit 220 may generate input voltage signal 228 representative of the leading edge peak of the rectified phase controlled input voltage $V_{RECT}$ 215, which may be representative of the conduction phase angle (e.g., Triac conduction angle). Input voltage signal 228 may be used in the converter controller 255 for dimming control and for over/under voltage protection.

The Flyback regulated power converter 230 receives the input voltage $V_{RECT}$ 215 at primary winding 241 of the transformer T1, 240, which is coupled to switching device S1, 251. In each switching cycle when switching device S1, 251 is in an ON state (e.g., closed), energy is stored in primary winding 241. Due to the anti-phase winding direction of transformer T1, 240, output diode D1, 244 may be reverse biased during this time, resulting in no current passing through secondary winding 242. When switching device S1, 251 is in an OFF state (e.g., open) the stored energy in the magnetic field of the transformer core is transferred through the forward biased output diode D1, 244 to the output terminal across the output bulk capacitor Co 238. Output voltage $V_O$, 270, referenced to output/secondary ground 202, and output current $I_O$, 271 may be applied to load 275 (which, in one example, may include an LED lamp) through the enhanced active preload circuit 290 (e.g., enhanced active preload circuit 190). It should be appreciated that while enhanced active preload circuit 290 is shown as being coupled to the output interface of load 275, it may instead be coupled at the output of auxiliary winding 243.

Through rectifier diode 246 and filter capacitor C1, 247, a third auxiliary winding 243 on the transformer core that is referenced to the primary ground 201 may be used to provide feedback information of output voltage $V_O$, 270 at feedback terminal FB, 254 (with transfer ratio of second and third windings) to regulate the output and as well to generate a bias direct current (dc) supply voltage to the supply terminal BP, 256 of controller 255.

Controller 255 may further include input terminals for receiving switch current 252 (representative of current 235) and input voltage signal 228, and a resistor detect terminal R, 221 coupled to an external selective resistor 223 for detecting different optional modes of dimming/non-dimming operation. Controller 255 may process the received signals and generate drive signal 257 to drive switching device S1, 251 and regulate the output (e.g., output voltage Vo, 270 and/or output current Io, 271). It should be appreciated that in some examples, controller 255 (and its individual components) and switching element S1, 251 may be implemented as a monolithic integrated circuit 250, may be implemented with discrete electrical components, or may be implemented in a combination of discrete components and integrated circuits.

Flyback converter 200 may further include clamp circuitry 231 coupled across primary winding 241 to limit the maximum voltage across switching element S1, 251 due to the inductance of primary winding 241 and caused by the abrupt change in current when switching element S1, 251 is switched to the OFF state. A diode 233 may optionally be inserted as shown in FIG. 2 to prevent current return from switching device S1, 251 to the inductor in the event that oscillation occurs across switching device S1, 251.

The enhanced active preload circuit 290 may be configured to sense the dimming level (load level) and respond to either the load current or load voltage, or may indirectly respond to the input voltage phase angle (e.g., Triac conduction angle) by sensing the unfiltered voltage induced in the secondary or bias winding 242/243 or by receiving input voltage signal 228 from peak detection circuit 220. The direct or indirectly sensed signal may be referred to herein as a control signal. Each of these configurations of enhanced active preload circuit 290 are illustrated in the figures and discussed below in both isolated (e.g., Flyback) and non-isolated (e.g., Tapped Buck) converters. While specific examples are shown, it should be appreciated that the enhanced active preload circuit may be similarly used in any isolated or non-isolated converter.

FIG. 3 is a schematic illustrating an example isolated Tapped Buck LED driver 300 implementing input line phase control dimming and having an enhanced active preload circuit coupled 390 at its output. Similar to Flyback LED driver converter of FIG. 2, Tapped Buck LED driver 300 includes an enhanced active preload circuit 390 that may be configured to sense the dimming level (load level) and respond to either the load current or load voltage, or may indirectly respond to the input voltage phase angle (e.g., Triac conduction angle) by sensing the unfiltered voltage induced in the secondary or bias winding or by receiving an input voltage signal from a peak detection circuit. Moreover, enhanced active preload circuit 390 may be coupled to the output of the secondary or bias winding of the converter. Example preload circuits that may be used for enhanced active preload circuit 390 are described below with respect to FIGS. 4A, 5A, 6A, 7A, 7B, and 8A.

A rectified leading edge phase controlled input voltage (represented by waveform $V_{RECT}$ 315 referenced to input ground 301) may be applied at input terminals 307/309. In one example, the rectified leading edge phase controlled input voltage may be rectified leading edge phase controlled input voltage 115 provided from Triac dimmer 104 and rectifier bridge 110 through the input circuitry 118, as shown in FIG. 1. Tapped Buck LED driver 300 may further include peak detection circuit 320, which may be similar or identical to peak detection circuits 120 and 220 in FIGS. 1 and 2, respectively. Peak detection circuit 320 may include rectifier 322, resistor 324, and capacitor 326, and may generate input voltage signal 328 representative of the leading edge peak of the rectified phase controlled input voltage $V_{RECT}$ 315, which may be representative of the Triac conduction phase angle. Input voltage signal 328 may be used in the converter controller 355 for dimming control and for the over/under voltage protection.

Tapped Buck LED driver 300 may further include regulated power converter 330 coupled to receive input voltage $V_{RECT}$ 315 at its input. Power converter 300 may include switching device S1, 351 that, when in an ON state (e.g., closed), may cause current 335 to pass through inductor windings 341/342 of the inductor L1, 340 to the output load 375 (e.g., an LED lamp). Additionally, during this time, output bulk capacitor Co 338 may be charged, energy may be stored in inductor windings 341/342, and output voltage $V_O$, 370, referenced to output/secondary ground 302, and output current $I_O$, 371 may be applied to load 375 through the enhanced active preload circuit 390. Tapped Buck LED driver 300 may further include clamp circuitry 331 coupled to inductor L1, 340 to limit the maximum voltage across switching element S1, 351 caused by the abrupt change in current when switching element S1, 351 is switched to the OFF state. In some examples, diode 333 may optionally be inserted as shown in FIG. 3 to prevent current return from switching device 351 to the inductor in the event that oscillation occurs across switching device 351. When switching device S1, 351 is in an OFF state (e.g., open), the inductor circulating current 337 may pass through partial turns of second winding 342 and diode 336. In one example diode 336 may be a Schottky diode.

Through rectifier diode 346 and filter capacitor C1, 347, a third auxiliary winding 343 on the core of inductor L1, 340 that is referenced to primary/input ground 301 may be used to provide feedback information of output voltage $V_O$, 370 at feedback terminal FB, 354 (with transfer ratio of windings 343 and 342) to regulate the output and to generate a bias dc supply voltage to the supply terminal BP, 356 of controller 355.

Controller 355 may further include input terminals for receiving switch current 352 (representative of current 335) and input voltage signal 328, and a resistor detect terminal R, 321 coupled to an external selective resistor 323 for detecting different optional modes of dimming/non-dimming operation. Controller 355 may process the received signals and generate drive signal 357 to drive switching device S1, 351 and regulate the output (e.g., output voltage Vo, 370 and/or output current Io, 371). It should be appreciated that in some examples, controller 355 (and its individual components) and switching element S1, 351 may be implemented as a monolithic integrated circuit 350, may be implemented with discrete electrical components, or may be implemented in a combination of discrete components and integrated circuits.

While enhanced active preload circuit 390 is shown as being coupled to the output interface of load 375, it may instead be coupled at the output of auxiliary winding 343. Moreover, enhanced active preload circuit block 390 may be either referenced only to output ground 302 or referenced only to input ground 301. Enhanced active preload circuit 390 may be configured to sense the dimming level (load level) and respond to either the load current or load voltage, or may indirectly respond to the input voltage phase angle (e.g., Triac conduction angle) by sensing the unfiltered voltage across output winding 342, unfiltered voltage across bias winding 343, or input voltage signal 328 from peak detection circuit 320.

Figure 4A:
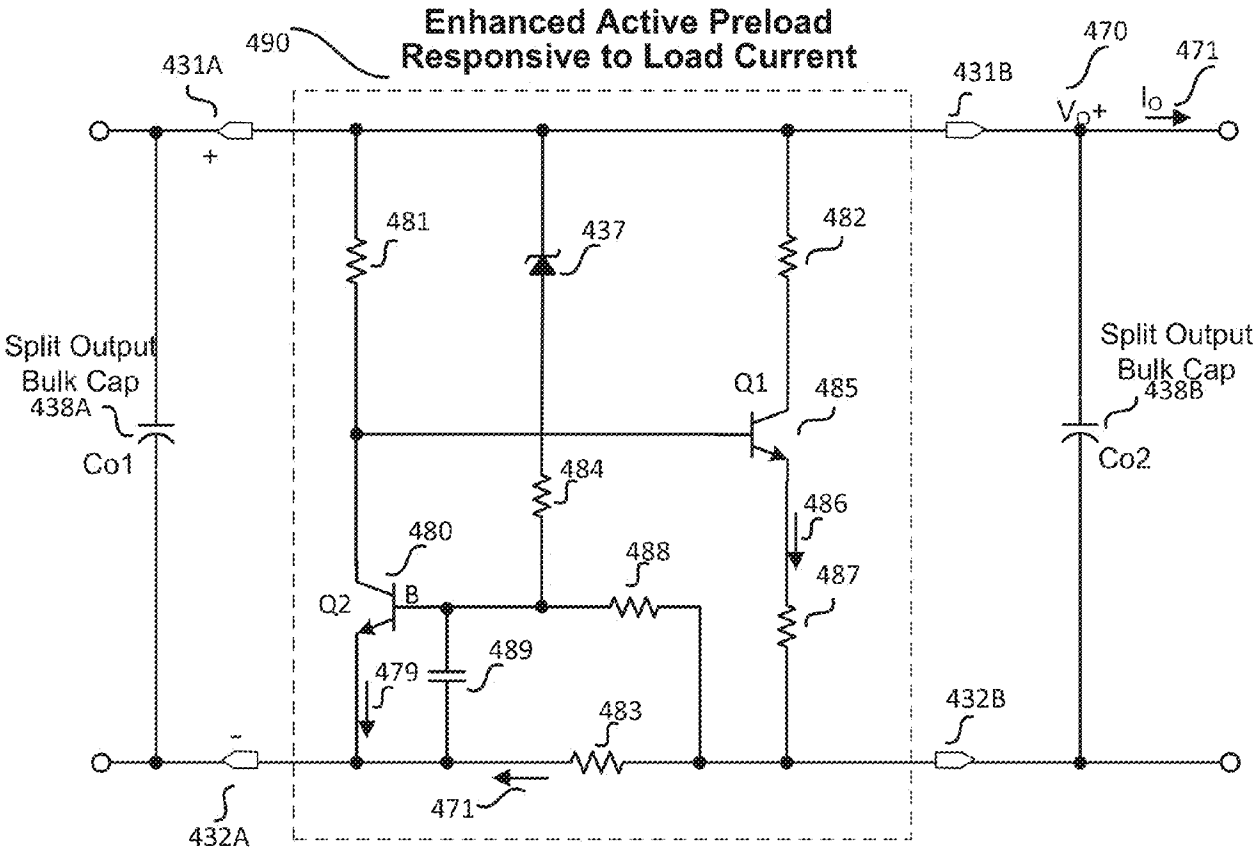
FIG. 4A is a schematic illustrating an example enhanced active preload circuit that senses and responds to the load current.

FIG. 4A is a schematic 400 illustrating an example enhanced active preload circuit 490 responsive to a load current (e.g., a control signal). Enhanced active preload circuit 490 is an example preload circuit that may be used for any of enhanced active preload circuits 190, 290, or 390, discussed above.

Enhanced active preload circuit 490 may be coupled to a power converter at input terminals 431A/432A and may be coupled to a load (e.g., an LED) at output terminals 431B/432B. In one example, the output bulk capacitor (e.g., bulk capacitors 138, 238, or 338) of the converter may be replaced by a first output capacitor Co1, 438A and a second output capacitor Co2, 438B inserted between input terminals 431A/432A and output terminals 431B/432B, respectively.

During operation, enhanced active preload circuit 490 may sink current 486 through switching device Q1, 485 that, in one example, may include a BJT transistor coupled to dissipative resistances 482 and 487. Switching device Q1, 485 may receive a biasing signal at its control terminal from biasing circuitry (e.g., elements 437, 480, 481, 483, 484, 488, and 489), and may sink current 486 based on this biasing signal.

For example, the load current $I_O$, 471 from the load may be sensed by resistor 483 on the output return path and may bias the control terminal B of the biasing transistor Q2, 480 through resistor 488 and filter capacitor 489. The biasing of transistor Q2, 480 may change in response to the voltage drop on the sense resistor 483 to sink current 479 that, when transistor Q2, 480 is in linear mode, may be proportional to the load current $I_O$, 471.

When the conduction angle (e.g., Triac conduction angle) used for phase-control of the input voltage is above an upper threshold (e.g., above 70° conduction angle), the load current $I_O$, 471 may remain above a threshold amount that biases biasing transistor Q2, 480 in saturation mode, causing the transistor to be in an ON state to operate substantially as a short circuit to pull the control terminal of preload switching device Q1, 485 low (e.g., to ground). This may cause switching device Q1, 485 to be in the OFF state, resulting in substantially no current 486 sinking through the enhanced active preload circuit 490. As a result, little to no power is dissipated by enhanced active preload circuit 490 at no-dim conditions or dimming conditions above a threshold value (e.g., above 70° conduction angle).

In deeper dimming conditions (e.g., below 70° conduction angle), the load current $I_O$, 471 may fall below the threshold amount needed to bias biasing transistor Q2, 480 in saturation mode. Specifically, the voltage across resistor 483, which is representative of the sensed load current, may decrease to a value that changes the bias on the control terminal B of biasing transistor Q2, 480 to cause transistor Q2, 480 to function in a linear mode. In this mode, transistor Q2, 480 may act as a current source that outputs a current 479 that is proportional to the load current $I_O$, 471. The current 479 sank through transistor Q2, 480 may be subtracted from the maximum current that can be directed from the output positive line through resistor 481 to the control terminal of switching device Q1, 485 to bias it in a linear mode. Since the sank current 479 through transistor Q2, 480 is linearly proportional to the load current $I_O$, 471, the current sank through switching device Q1, 485 may be inversely proportional to the load current $I_O$, 471. As a result, in deeper dimming conditions (e.g., below 70° conduction angle), the enhanced active preload circuit 490 may sink a larger preload current to extend the dim ratio by delaying undesired turn off of the LED load.

In some examples, enhanced active preload circuit 490 may further include Zener diode 437 and resistor 484 coupled between the positive output line and control terminal B of the biasing transistor Q2, 480. During a high output voltage condition, such as an open load, the breakdown current through Zener diode 437 and resistors 484 and 488 may initiate a fast biasing of transistor Q2, 480 into a saturation mode (acting as a short circuit), which may result in the control terminal of the switching device Q1, 485 being pulled down to a level that causes switching device Q1, 485 to be in an OFF state.

Figure 4B:
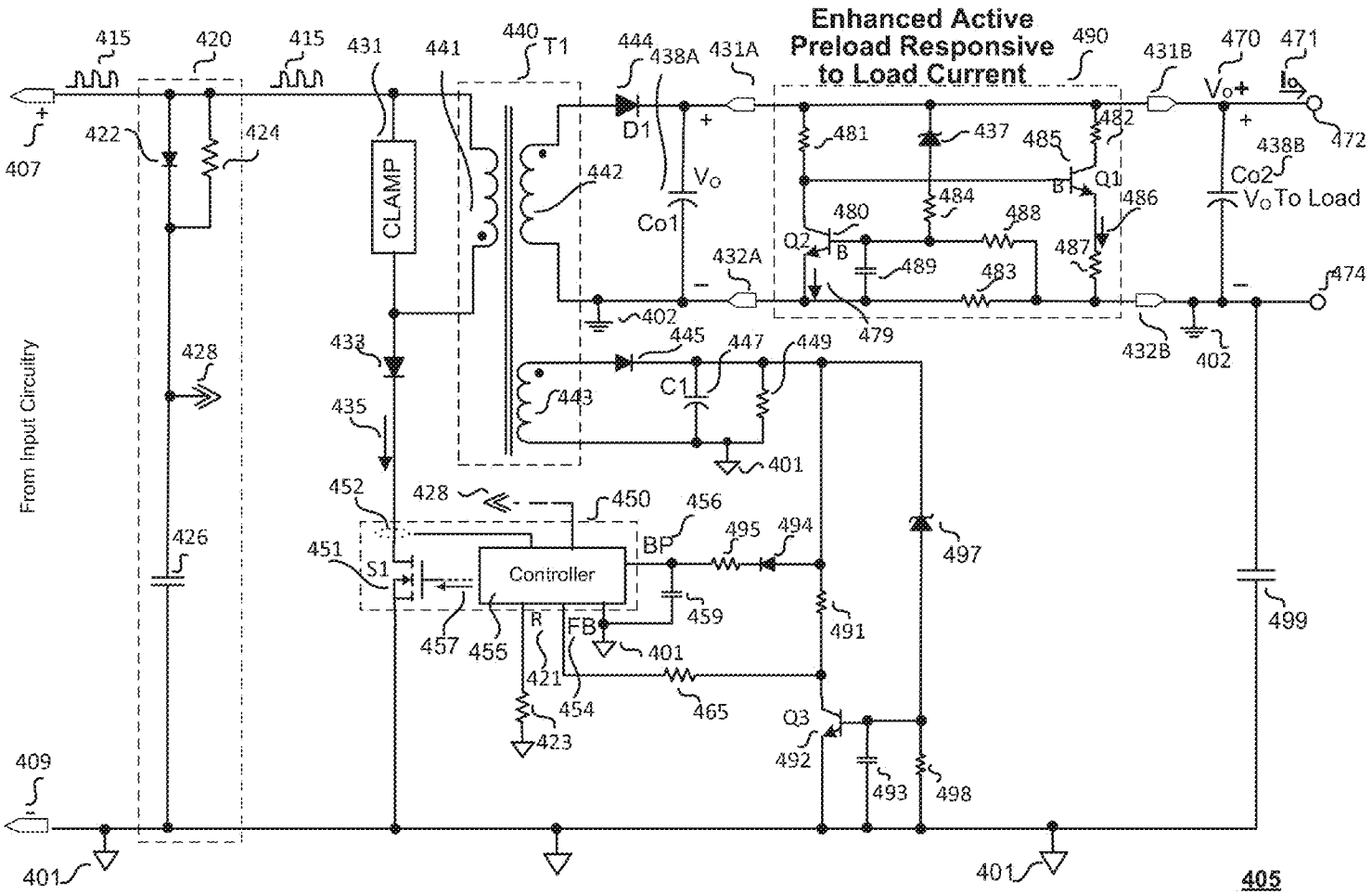
FIG. 4B is a schematic illustrating an isolated Flyback LED driver converter implementing input line phase control dimming and having the enhanced active preload of FIG. 4A.

FIG. 4B is a schematic illustrating an isolated Flyback LED driver converter 405 implementing input line phase control dimming and having the enhanced active preload 490 of FIG. 4A. A rectified leading edge phase controlled input voltage (represented by waveform $V_{RECT}$ 415 referenced to input ground 401) may be applied at input terminals 407/409. In one example, the rectified leading edge phase controlled input voltage may be rectified leading edge phase controlled input voltage 115 provided from Triac dimmer 104 and rectifier bridge 110 through the input circuitry 118, as shown in FIG. 1.

Flyback LED driver converter 405 may further include peak detection circuit 420, which may be the same as or similar to peak detection circuits 120, 220, and 320 in FIGS. 1, 2, and 3, respectively. In one example, peak detection circuit 420 may include rectifier 422, resistor 424, and capacitor 426. As described with respect to FIG. 1, peak detection circuit 420 may generate input voltage signal 428 representative of the leading edge peak of the rectified phase controlled input voltage $V_{RECT}$ 415, which may be representative of the conduction phase angle (e.g., Triac conduction angle). Input voltage signal 428 may be used in the converter controller 455 for dimming control and for the over/under voltage protection.

The Flyback regulated power converter receives the input voltage $V_{RECT}$ 415 at primary winding 441 of the transformer T1, 440, which is coupled to switching device S1, 451. In each switching cycle when switching device S1, 451 is in an ON state (e.g., closed), energy is stored in primary winding 441. Due to the anti-phase winding direction of transformer T1, 440, output diode D1, 444 may be reverse biased during this time, resulting in no current passing through secondary winding 442. When switching device S1, 451 is in an OFF state (e.g., open) the stored energy in the magnetic field of the transformer core is transferred through the forward biased output diode D1, 444 to the output terminal across the output bulk capacitors Co1 438A and Co1 438B. Output voltage $V_O$, 470, referenced to output/secondary ground 402, and output current $I_O$, 471 may be applied to load (which, in one example, may include an LED lamp) across output terminals 472/474 through the enhanced active preload circuit 490. A capacitor 499 may be used as a decoupling capacitance between input ground 401 and output ground 402. It should be appreciated that while enhanced active preload circuit 490 is shown as being coupled to the output interface of the load, it may instead be coupled at the output of auxiliary (bias) winding 443.

Through rectifier diode 445, filter capacitor C1, 447, and resistor 449, a third (auxiliary/bias) winding 443 on the transformer core that is referenced to the primary ground 401 may be used to provide feedback information of output voltage $V_O$, 470 through resistor 491 and feedback resistor 465 at feedback terminal FB, 454 (with transfer ratio of windings 443 and 442) to regulate the output and as well to generate a bias dc supply voltage to the supply terminal BP, 456 of controller 455. The bias dc supply voltage may be provided from the rectified and filtered voltage of third (auxiliary/bias) winding 443 through a blocking diode 494 (to block any disturbance from the supply terminal BP, 456 to the feedback terminal FB, 454) and through the current limiting resistor 495 and the BP terminal capacitor 459. Zener diode 497 at the dc output of third (auxiliary/bias) winding 443 may provide fast output transient over voltage protection by breaking down at an overshoot threshold, resulting in a bias voltage for transistor Q3, 492 across resistor 498 and capacitor 493 that causes transistor Q3, 492 to pull the voltage at the feedback terminal FB, 454 low to disable the controller drive signal 457.

Controller 455 may further include input terminals for receiving switch current 452 (representative of current 435) and input voltage signal 428, and a resistor detect terminal R, 421 coupled to an external selective resistor 423 for detecting different optional modes of dimming/non-dimming operation. Controller 455 may process the received signals and generate drive signal 457 to drive switching device S1, 451 and regulate the output (e.g., output voltage Vo, 470 and/or output current Io, 471). It should be appreciated that in some examples, controller 455 (and its individual components) and switching element S1, 451 may be implemented as a monolithic integrated circuit 450, may be implemented with discrete electrical components, or may be implemented in a combination of discrete components and integrated circuits.

Flyback LED driver converter 405 may further include clamp circuitry 431 coupled across primary winding 441 to limit the maximum voltage across switching element S1, 451 due to the inductance of primary winding 441 and caused by the abrupt change in current when switching element S1, 451 is switched to the OFF state. A diode 433 may optionally be inserted as shown in FIG. 4B to prevent current return from switching device S1, 451 to the inductor in the event that oscillation occurs across switching device S1, 451.

The enhanced active preload circuit 490 may be the same preload circuit described above with respect to FIG. 4A. In the illustrated example, enhanced active preload circuit 490 may be referenced only to output ground 402 and may be coupled at the output interface of the load by input terminals 431A/432A and output terminals 431B/432B.

As described above, enhanced active preload circuit 490 may be responsive to the load current Io, 471. During conditions with little to no dimming, the load current Io, 471 may remain above a threshold value, causing transistor Q2, 480 to be biased in the saturation mode to an ON state in which it acts substantially as a short circuit. As a result, the control terminal of switching device Q1, 485 may be pulled low (e.g., to ground), keeping the device in an OFF state in which it sinks substantially no current. Thus, in conditions with little to no dimming, little to no current is sank through enhanced active preload circuit 490.

In deeper dimming conditions, the load current Io, 471 may fall below the threshold value that keeps transistor Q2, 480 in saturation mode. In these conditions, the voltage drop across sense resistor 483 may cause the bias voltage at the control terminal B of transistor Q2, 480 to fall to a level corresponding to the linear mode of the transistor. As a result, the current sank through transistor Q2, 480 may be proportional to the load current Io, 471. The linear proportional change in the current sank though transistor Q2, 480 causes a linear change in the bias at the control terminal of switching device Q1, 485, resulting in an inversely proportional relationship between the current 486 sank through switching device Q1, 485 and the load current Io, 471. Thus, in deeper dimming conditions, the enhanced active preload circuit 490 sinks a higher preload current 486 to extend the dimming ratio by delaying the undesired turn off of the LED load.

While FIG. 4B shows enhanced active preload circuit 490 used in an isolated Flyback converter, it should be appreciated that enhanced active preload circuit 490 may similarly be used in any isolated or non-isolated LED driver converter.

Figure 5A:
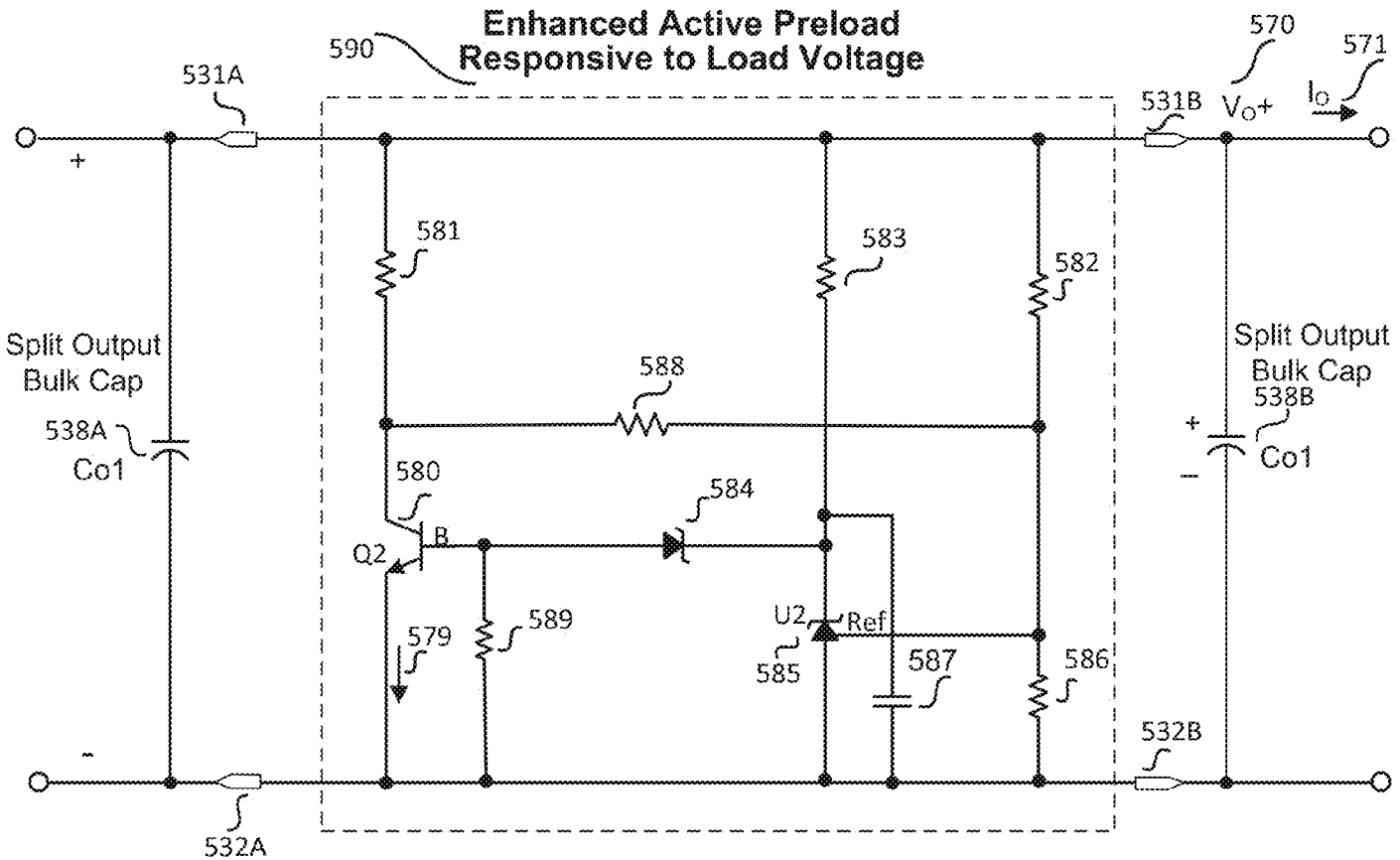
FIG. 5A is a schematic illustrating another example enhanced active preload circuit that senses and responds to the load voltage.

FIG. 5A is a schematic 500 illustrating another example enhanced active preload circuit 590 that senses and responds to the load voltage (e.g., control signal), which may be representative of a load change (e.g., dimming level). In a regulated current LED driver with dimming control, the output voltage may change as the current in the LED string changes in accordance with the Volt/Ampere characteristic of the LED load. Enhanced active preload circuit 590 is an example preload circuit that may be used for any of enhanced active preload circuits 190, 290, or 390, discussed above.

The output voltage signal Vo, 570 may be utilized by enhanced active preload 590 to control a sinking preload current 579 that rises to a non-zero value at a threshold level of dimming (e.g., at a Triac conduction angle of 70°). As the load current decreases (e.g., corresponding to deeper dimming caused by a reduced conduction angle of a Triac), due to the well-known V/A characteristic of the LED lamp, the output voltage Vo, 570 may also decrease. At deeper dimming conditions, a larger amount of current 479 is sank through the enhanced active preload 590 to extend the dim ratio by delaying undesired turn off of the LED load. The enhanced active preload 590 may also apply sufficient hysteresis to prevent undesirable flicker around the turn-off/turn-on thresholds.

As shown in FIG. 5A, the enhanced active preload circuit 590 is coupled in between the split output bulk capacitors Co1, 538A and Co2, 538B at the output interface through the input terminals 531A/532A and output terminals 531B/532B. Enhanced active preload circuit 590 may include a resistive divider 582/586 to provide a proportional, scaled-down output voltage signal at reference terminal of an accurate voltage reference (e.g., voltage regulator) U2, 585 that, in one example, may be a 1% regulator TL431 to provide an accurate threshold level at which the enhanced active preload circuit 590 engages. Resistors 582, 586, and 581 may set the threshold and resistor 588 may add hysteresis to the circuit. Capacitor 587 provides a decoupling noise path for proper function of the accurate voltage reference U2, 585.

During operation, enhanced active preload circuit 590 may sink current 579 through switching device Q2, 580 that, in one example, may include a BJT transistor. Switching device Q2, 580 may receive a biasing signal at its control terminal B from biasing circuitry (e.g., elements 582, 583, 584, 585, 586, 587, 588, and 589), and may sink current 579 based on this biasing signal.

During normal operation with little to no dimming (e.g., above 70° conduction angle), the LED load current Io, 571 and LED load voltage Vo, 570 may be high. As a result, the scaled-down signal of the output voltage Vo, 570 across resistor 586 at the reference terminal of voltage reference U2, 585 may be above the Vref of voltage reference U2, 585, causing the cathode voltage to be pulled down to Vref and sinking current from the positive output line through resistor 583 to ground. This may cause Zener diode 584 to remain in an OFF state (high impedance), preventing any bias to the control terminal B of switching device Q2, 580. While the switching device Q2, 580 remains in the OFF state, little to no sinking current may pass through resistor 581. Thus, the values of resistors 582 and 586 may be selected such that when the output voltage Vo, 570 is below a threshold value, the switching device Q2, 580 may remain in an OFF state, sinking little to no preload current 579 and consuming little to no power. This may result in greater efficiency in normal operation above the predefined activation threshold of enhanced active preload circuit 590.

As the conduction angle is decreased (corresponding to deeper dimming), the voltage across resistor 586 may similarly decrease and approach the threshold voltage Vref of voltage reference U2, 585. A first threshold value $Vo_{th1}$ may be defined by the following equation:

$$\left[Vo_{th1} = Vref * \frac{[(R581 + R588) \,||\, R582] + R586}{R586}\right]$$

If the output voltage Vo, 570 reaches this first threshold $Vo_{th1}$ that, in one example, may be approximately 20.1 V, voltage reference U2, 585 may turn on and the cathode voltage may be pulled up, thereby turning Zener diode 584 on. This may cause a biasing of switching device Q2, 580 through resistors 583 and 589. The biasing current through Zener diode 584 to the control terminal B of switching device Q2, 580 across resistor 589 may put switching device Q2, 580 in the linear mode, sinking a preload current through preload resistor 581 that is inversely proportional to the load current Io, 571 and voltage Vo, 571.

However, after falling below the first threshold value $Vo_{th1}$, the output divider ratio may change due to the hysteresis resistor 588 being coupled in parallel to resistor 586. Thus, if the output voltage Vo, 570 increases (e.g., due to a noise related fluctuation), the voltage reference U2, 585 may change state at a second, higher output threshold $Vo_{th2}$ that may be defined by the following equation:

$$Vo_{th2} = Vref * \left[\frac{R582 + [R588) \,||\, R586]}{[R588 \,||\, R586]}\right]$$

In one example, the second output threshold $Vo_{th2}$ may be approximately 20.9 V, providing sufficient hysteresis (~0.8 V) to prevent undesirable flickering. While specific examples are given, it should be appreciated that these thresholds should be adjusted based on the turn-on threshold of the actual LED load.

In one example, the addition of the enhanced active preload circuit 590 of FIG. 5A to an LED driver with a Triac phase control dimmer may address the issue of a "Leaky Triac Dimmer". As known to those of ordinary skill in the art, many high-powered Triac dimmers include an LC input filter, which may cause flickering in the LED load even if the Triac is turned off. While the LED driver is off, the input filter capacitor may draw some small current that causes flicker by turning the load on and off. Enhanced active preload circuit 590 loads the output such that the LED turn-on voltage would not be reached if the Triac dimmer is off. This is accomplished by sensing the output voltage Vo, 570 and activating the enhanced active preload circuit 590 whenever the voltage Vo, 570 is below a certain threshold. This threshold may be determined by measuring the LED turn-on voltage.

Figure 5B:
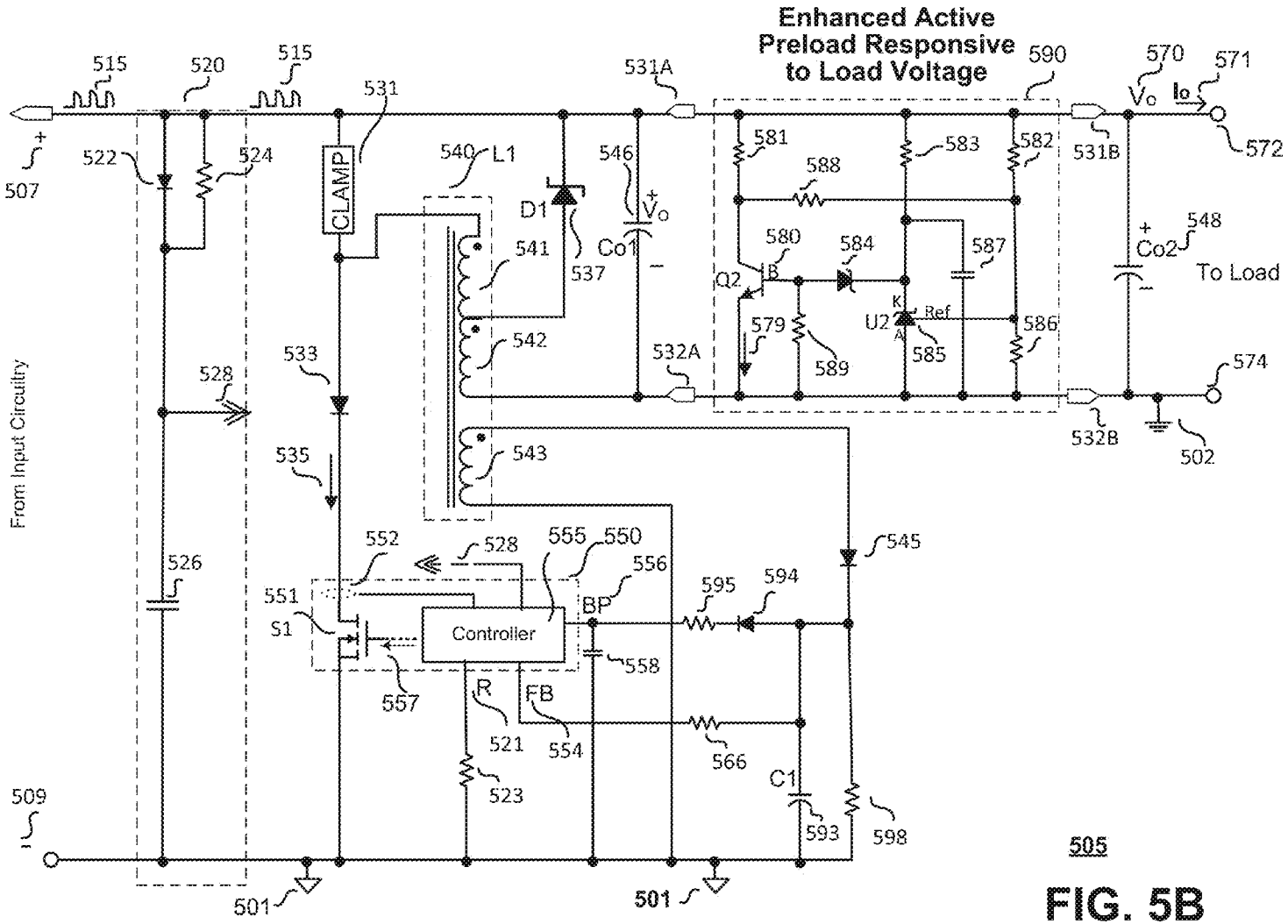
FIG. 5B is a schematic illustrating an example non-isolated Tapped Buck LED driver converter implementing input line phase control dimming and having the enhanced active preload of FIG. 5A.

FIG. 5B is a schematic illustrating a non-isolated Tapped Buck LED driver converter 505 implementing input line phase control dimming and having the enhanced active preload 590 of FIG. 5A. A rectified leading edge phase controlled input voltage (represented by waveform $V_{RECT}$ 515 referenced to input ground 501) may be applied at input terminals 507/509. In one example, the rectified leading edge phase controlled input voltage may be the rectified leading edge phase controlled input voltage 115 provided from Triac dimmer 104 and rectifier bridge 110 through the input circuitry 118, as shown in FIG. 1.

Tapped Buck LED driver converter 505 may further include peak detection circuit 520, which may be the same as or similar to peak detection circuits 120, 220, 320, and 420 in FIGS. 1, 2, 3, and 4, respectively. Peak detection circuit may include rectifier 522, resistor 524, and capacitor 526, and may generate input voltage signal 528 representative of the leading edge peak of the rectified phase controlled input voltage $V_{RECT}$ 515, which may be representative of the Triac conduction phase angle. Input voltage signal 528 may be used in the converter controller 555 for dimming control and for the over/under voltage protection.

Tapped Buck LED driver converter 505 may include switching device S1, 551 that, when in an ON state (e.g., closed), may cause current 535 to pass through inductor windings 541/542 of the inductor L1, 540 to the output load (e.g., an LED lamp). Additionally, during this time, output bulk capacitors Co1 538A and Co2 538B may be charged, energy may be stored in inductor windings 541/542, and output voltage $V_O$, 570 (referenced to output/secondary ground 502) and output current $I_O$, 571 may be applied to a load (which, in one example, may include an LED lamp) through the enhanced active preload circuit 590 and output terminals 572/574. Tapped Buck LED driver converter 505 may further include clamp circuitry 531 coupled to inductor L1, 540 to limit the maximum voltage across switching element S1, 551 caused by the abrupt change in current when switching element S1, 551 is switched to the OFF state. In some examples, diode 533 may optionally be inserted, as shown in FIG. 5, to prevent current return from switching device S1, 551 to the inductor in the event that oscillation occurs across switching device S1, 551. When switching device S1, 551 is in an OFF state (e.g., open), the inductor circulating current 537 may pass through partial turns of second winding 542 and diode 536. In one example diode 536 may be a Schottky diode.

Through rectifier diode 545 and filter capacitor C1, 593, a third (auxiliary/bias) winding 543 on the transformer core that is referenced to the primary ground 501 may be used to provide feedback information of output voltage $V_O$, 570 at feedback terminal FB, 554 (with transfer ratio of windings 543 and 542) through resistor 566 to regulate the output and as well to generate a bias dc supply voltage to the supply terminal BP, 556 of controller 555 through a blocking diode 594 and through the current limiting resistor 595 and BP terminal capacitor 558.

Controller 555 may further include input terminals for receiving switch current 552 and input voltage signal 528, and a resistor detect terminal R, 521 coupled to an external selective resistor 523 for detecting different optional modes of dimming/non-dimming operation. Controller 555 may process the received signals and generate drive signal 557 to drive switching device S1, 551 and regulate the output (e.g., output voltage Vo, 570 and/or output current Io, 571). It should be appreciated that in some examples, controller 555 (and its individual components) and switching element S1, 551 may be implemented as a monolithic integrated circuit 550, may be implemented with discrete electrical components, or may be implemented in a combination of discrete components and integrated circuits.

The enhanced active preload circuit 590 may be referenced only to the output ground 502 and may be responsive to the load voltage Vo, 570, which may be responsive to the dimming level, as explained above with respect to FIG. 5A.

As discussed above, enhanced active preload circuit 590 may utilize output voltage signal Vo, 570 to control a sinking preload current 579 that rises to a non-zero value at a threshold level of dimming level (e.g., at a Triac conduction angle of 70°). As the load current decreases (e.g., corresponding to deeper dimming caused by a reduced conduction angle of a Triac), due to the well-known V/A characteristic of the LED lamp, the output voltage Vo, 570 may also decrease. At deeper dimming conditions, a larger amount of current 479 is sank through the enhanced active preload 590 to extend the dim ratio by delaying undesired turn off of the LED load. The enhanced active preload 590 may also apply sufficient hysteresis to prevent undesirable flicker around turn-off/turn-on thresholds.

While FIG. 5B shows enhanced active preload circuit 590 used in a non-isolated Tapped Buck converter, it should be appreciated that enhanced active preload circuit 590 may similarly be used in any isolated or non-isolated LED driver converter.

Figure 6A:
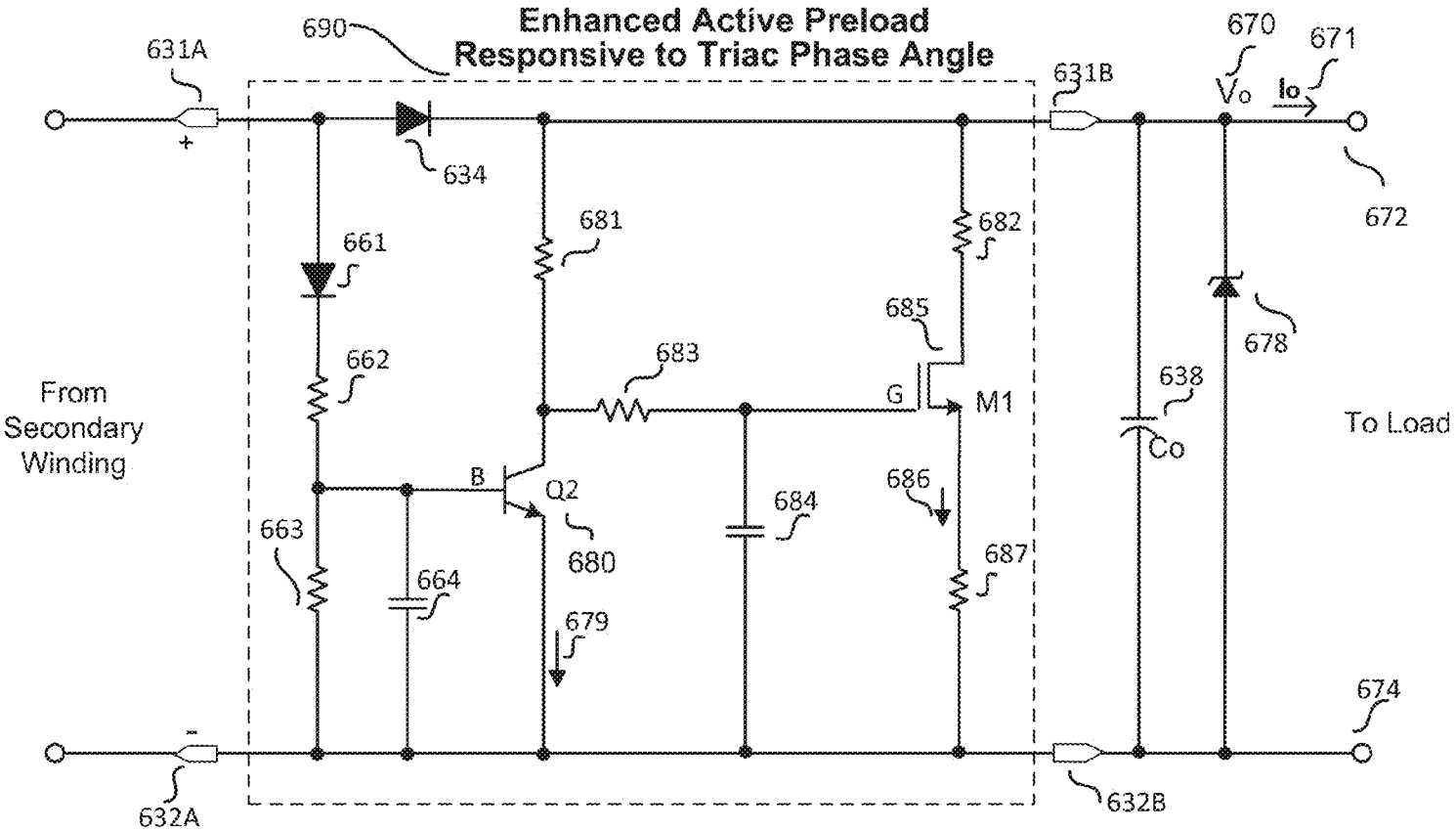
FIG. 6A is a schematic illustrating another example enhanced active preload circuit that indirectly senses and responds to the phase controlled line voltage.

FIG. 6A is a schematic illustrating another example 600 enhanced active preload circuit 690 that indirectly senses and responds to the phase controlled line voltage. Enhanced active preload circuit 690 is an example preload circuit that may be used for any of enhanced active preload circuits 190, 290, or 390, discussed above.

In one example, enhanced active preload circuit 690 may indirectly sense the conduction angle of a Triac dimmer using the unfiltered output voltage on a secondary winding of the converter (e.g., control signal), which may be representative of the Triac phase angle. Thus, input terminals 631A/632A may be coupled to an output winding (e.g., the secondary winding of a Flyback transformer) and the output terminals 631B/632B of enhanced active preload circuit 690 may be coupled across the output bulk capacitor Co, 638. Output terminals 672/674 may be coupled to a load (e.g., one or more LEDs) to provide an output voltage $V_O$, 670 and output current $I_O$, 671 to the load. A Zener diode 678 may be coupled across the load.

During operation, enhanced active preload circuit 690 may sink current 686 through switching device M1, 685 that, in one example, may include a MOSFET. Switching device M1, 685 may receive a biasing signal at its control terminal G from biasing circuitry (e.g., elements 634, 661, 662, 663, 664, 680, 681, 683, and 684), and may sink current 686 based on this biasing signal.

Depending on the values selected for the components of enhanced active preload circuit 690, the circuit may operate in one of two different modes of operation. In a first mode, transistor Q2, 680 may operate in a linear mode as a current source to sink a current 679 from the positive output line to the output ground in response to the unfiltered phase controlled output voltage sensed across the output winding. When the conduction angle falls below an upper threshold (e.g., a conduction angle of 70°), the bias current provided to control terminal B of transistor Q2, 680 may also decrease, causing transistor Q2, 680 to operate in a linear mode. In this mode, transistor Q2, 680 may sink a current 679 through resistor 681 from the positive output line to the output ground that is proportional to the unfiltered voltage induced in the output/secondary winding, which may be a scaled down representation of the phase controlled input voltage. The linearly changing current 679 through transistor Q2, 680 may be subtracted from the biasing current of the switching device M1, 685, which may be fed from the positive output rail through resistors 681 and 683 to charge capacitor 684 at the control terminal G of switching device M1, 685. As a result, the bias voltage that builds up on capacitor 684 at control terminal G of switching device M1, 685 (operating in linear mode) may be inversely proportional to the current 679 passing though transistor Q2, 680 and thus, inversely proportional to the unfiltered output voltage on the secondary winding that is a representative of the phase controlled input voltage (e.g., the Triac conduction angle).

In a second mode, the values of the components of enhanced active preload circuit 690 may be selected such that transistor Q2, 680, through biasing components diode 661, resistors 662 and 663, and capacitor 664, may operate only in switch mode (BJT saturation mode). In this mode, during conductions periods when a voltage is induced at the output winding of the converter, a bias current may be provided to control terminal B of transistor Q2, 680 (through diode 661, resistors 662 and 663, and capacitor 664) to cause transistor Q2, 680 to operate in an ON state. As a result, the control terminal G of the switching device M1, 685 may be pulled low, thereby discharging capacitor 684 and deactivating switching device M1, 685. During non-conduction periods when no voltage is induced at the output winding of the converter, transistor Q2, 680 may remain in an OFF state, resulting in the control terminal G of the switching device M1, 685 being pulled up to the positive output line and capacitor 684 being charged through resistors 681 and 683 to activate the switching device M1, 685. The averaged gating (biasing) voltage across capacitor 684 may be proportional to the non-conduction period of the input line cycle or inversely proportional to the conduction period of input line cycle. In a linear mode of operation, switching device M1, 685 may act as a current source, resulting in a sinking current 686 through dissipative resistances 682 and 687 that is inversely proportional to the conduction period of the input line cycle.

It should be appreciated that by selecting the proper values for the biasing components of transistor Q2, 680, the transistor may be kept in an ON state for conduction angles above an upper threshold (e.g., above 70° conduction angle) to sink a maximum value of current 679 through resistor 681, thereby pulling down control terminal G of switching device M1, 685. This may cause switching device M1, 685 to remain in an OFF state with little to no sinking current 686 through the transistor. This may advantageously result in little to no power loss at normal operation above the preload activation threshold.

Figure 6B:
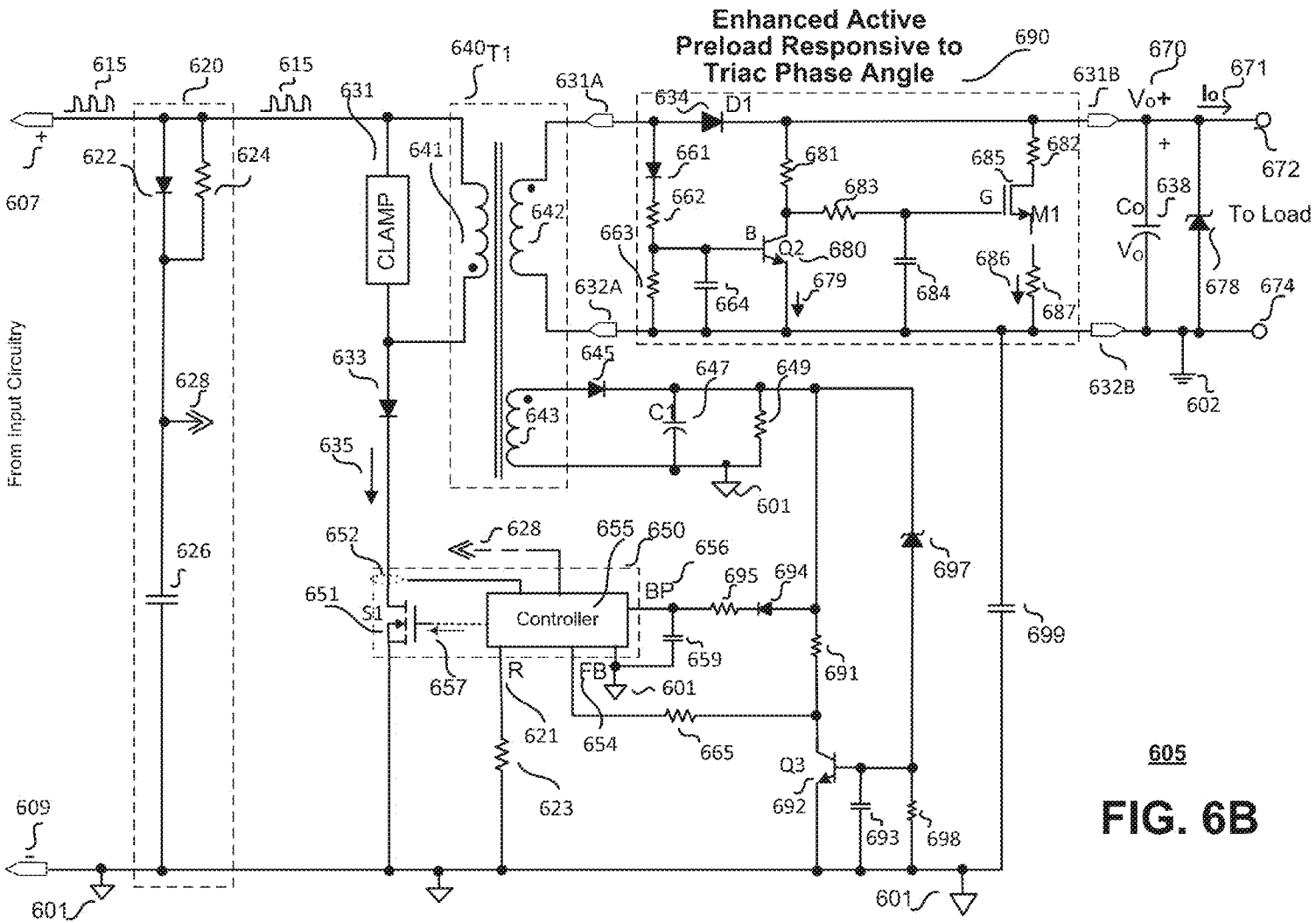
FIG. 6B is a schematic illustrating an example isolated Flyback LED driver converter implementing input line phase control dimming and having the enhanced active preload of FIG. 6A.

FIG. 6B is a schematic illustrating an example isolated Flyback LED driver converter 605 implementing input line phase control dimming (e.g., using a Triac leading edge phase control dimmer) and having the enhanced active preload 690 of FIG. 6A. The components and operation of Flyback LED driver converter 605 is similar to Flyback LED driver converter 405 of FIG. 4B, except enhanced active preload 490 is replaced with enhanced active preload 690. To avoid repetition, a detailed discussion of Flyback LED driver converter 605 will be omitted and only a brief description will be provided.

Flyback LED driver converter 605 may receive a rectified leading edge phase controlled input voltage (represented by waveform $V_{RECT}$ 615 referenced to input ground 601) at input terminals 607/609. Flyback LED driver converter 605 may include peak detection circuit 620, which may include rectifier 622, resistor 624, and capacitor 626, and may generate input voltage signal 628. Flyback LED driver converter 605 may further include transformer T1, 640 having primary winding 641, secondary winding 642, and auxiliary winding 643. Enhanced active preload circuit 690 may be coupled between secondary winding 642 and the load by input terminals 631A/632A and output terminals 631B/632B, respectively. It should be appreciated that while enhanced active preload circuit 690 is shown as being coupled to the output interface of the load, it may instead be coupled at the output of auxiliary winding 643.

An output voltage $V_O$, 670, referenced to output/secondary ground 602, and output current $I_O$, 671 may be applied to a load through the enhanced active preload circuit 690 and output terminals 672 and 674. A bulk capacitor Co 638 and Zener diode 678 may be coupled across the load. Flyback regulated power converter 605 may optionally include capacitor 699 between input ground 601 and output ground 602.

Through rectifier diode 645, filter capacitor C1, 647, and resistor 649, auxiliary winding 643 may provide feedback information at feedback terminal FB, 654 (with transfer ratio of second and third windings) through resistor 691 and feedback resistor 665 and may provide a bias dc supply voltage to the supply terminal BP, 656 of controller 655. The bias dc supply voltage may be provided through a blocking diode 694 and a current limiting resistor 695 and BP terminal capacitor 659). Zener diode 697 at the dc output of auxiliary winding 643 may provide fast output transient over voltage protection by breaking down at an overshoot threshold, resulting in a bias voltage for transistor Q3, 692 across resistor 698 and capacitor 693 that causes transistor Q3, 692 to pull the voltage at the feedback terminal FB, 654 low to disable the controller drive signal 657.

Controller 655 may further include input terminals for receiving switch current 652 (representative of current 635) and input voltage signal 628, and a resistor detect terminal R, 621 coupled to an external selective resistor 623. Controller 655 may generate drive signal 657 to drive switching device S1, 651 and regulate the output. It should be appreciated that in some examples, controller 655 (and its individual components) and switching element S1, 651 may be implemented as a monolithic integrated circuit 650, may be implemented with discrete electrical components, or may be implemented in a combination of discrete components and integrated circuits.

Flyback LED driver converter 605 may further include clamp circuitry 631 coupled across primary winding 641 and optional diode 633 inserted as shown in FIG. 6B.

The enhanced active preload circuit 690 at the output interface may be only referenced to output ground 602. As discussed above with respect to FIG. 6B, the enhanced active preload circuit 690 may indirectly sense the input phase angle using the voltage across secondary winding 642 and may sink current 686 through switching device Q1, 685 that, in one example, is shown as switching device M1, 685 coupled between dissipative resistances 682 and 687. Enhanced active preload circuit 690 may operate in a first linear mode of operation of transistor Q2, 680 or a second switch mode of operation for transistor Q2, 680, depending on the values of the components of enhanced active preload circuit 690.

While FIG. 6B shows enhanced active preload circuit 690 used in an isolated Flyback converter, it should be appreciated that enhanced active preload circuit 590 may similarly be used in any isolated or non-isolated LED driver converter.

Figure 7A:
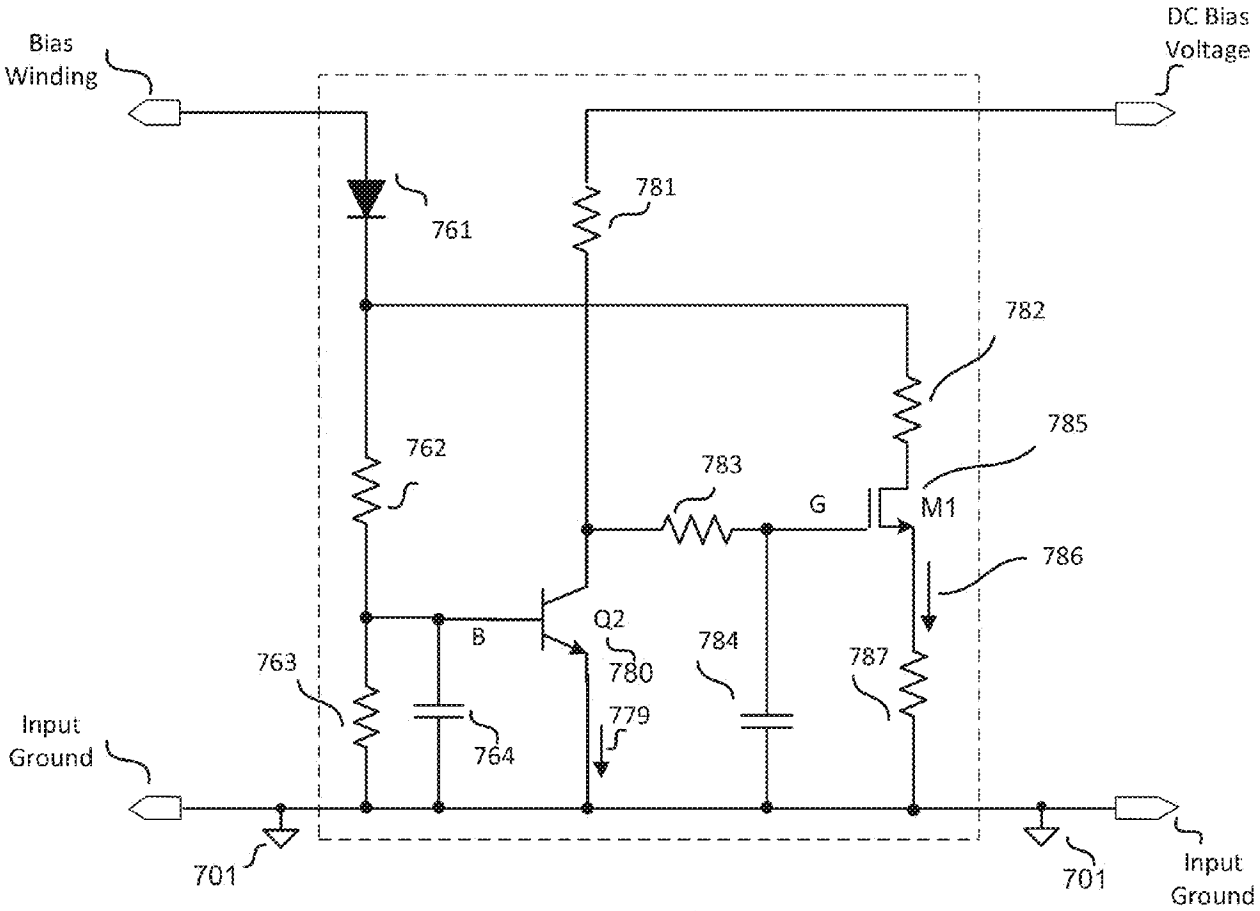
FIG. 7A is a schematic illustrating another example enhanced active preload implemented across the bias winding and referenced to input ground.

FIG. 7A is a schematic illustrating another example enhanced active preload circuit 700 that is responsive to the input line conduction angle as indirectly sensed from the voltage across a bias winding. Enhanced active preload circuit 700 is similar to enhanced active preload circuit 600 of FIG. 6A, except that the unfiltered voltage across the bias winding has been utilized as an indirect indication of the phase angle rather than the unfiltered output voltage on secondary winding. Enhanced active preload circuit 700 is an example preload circuit that may be used for any of enhanced active preload circuits 190, 290, or 390, discussed above.

In FIG. 7A the enhanced active preload circuit 700 may receive an unfiltered voltage signal representative of the line voltage conduction angle at input terminals reference to input ground 701 (e.g., a control signal in a Flyback converter with primary control across the bias winding on the Flyback transformer) and a bias rectified/filtered voltage. Enhanced active preload circuit 700 may include diode 761 and resistors 762 and 763 to charge capacitor 764 at each leading edge of the conduction duration of the phase controlled input line voltage. Capacitor 764 may bias the transistor Q2, 780 through control terminal B of the transistor Q2, 780.

During operation, enhanced active preload circuit 700 may sink current 786 through switching device M1, 785 that, in one example, may include a MOSFET. Switching device M1, 785 may receive a biasing signal at its control terminal G from biasing circuitry (e.g., elements 761, 762, 763, 764, 780, 781, 783, and 784), and may sink current 786 based on this biasing signal.

In one example, the value of the components of enhanced active preload circuit 700 may be selected such that transistor Q2, 780 may operate in saturation mode as a switch to apply a square pulsating signal through resistor 781 and RC filter components 783 and 784 to the control terminal G of the switching device M1, 785. Resistor 781 may be coupled to the dc bias voltage (rectified and filtered by the bulk capacitor of the bias supply). When transistor Q2, 780 is biased in an ON state during conducting periods of the phase controlled input line voltage, the control terminal G of the switching device M1, 785 may be pulled low. When transistor Q2, 780 is biased in an OFF state during non-conducting periods, the dc bias voltage may be applied to the control terminal G of the switching device M1, 785. Averaging of these pulsating square waves through RC filter resistor 783 and capacitor 784 may keep switching device M1, 785 in a linear mode sinking a preload current 786 through resistors 782 and 787 that is inversely proportional to the line controlled conduction angle.

It should be appreciated that while preload resistor 782 may be coupled to the output terminal of dc bias supply across a bias bulk output capacitor, it may instead be coupled to rectifier diode 761 to improve performance by preventing any interfering effect of preload current on the feedback and bias supply that are extracted from the bias winding.

In another example, the values of the components of enhanced active preload circuit 700 may be selected such that transistor Q2, 780 may be biased through diode 761 and resistors 762 and 763 to operate in a linear mode as a current source to sink a current 779 that is proportional to the phase angle of the controlled input voltage. The current 779 through transistor Q2, 780 may be subtracted from the biasing current of the switching device M1, 785, which may be fed from the positive output rail through resistors 781 and 783 to charge capacitor 784 at the control terminal G of switching device M1, 785. As a result, the bias voltage that builds up on capacitor 684 at control terminal G of switching device M1, 685 (operating in linear mode) may be inversely proportional to the current 679 passing though transistor 680 and thus, inversely proportional to the unfiltered output voltage on the secondary winding that is a representative of the phase controlled input voltage (e.g., the Triac conduction angle).

Figure 7B:
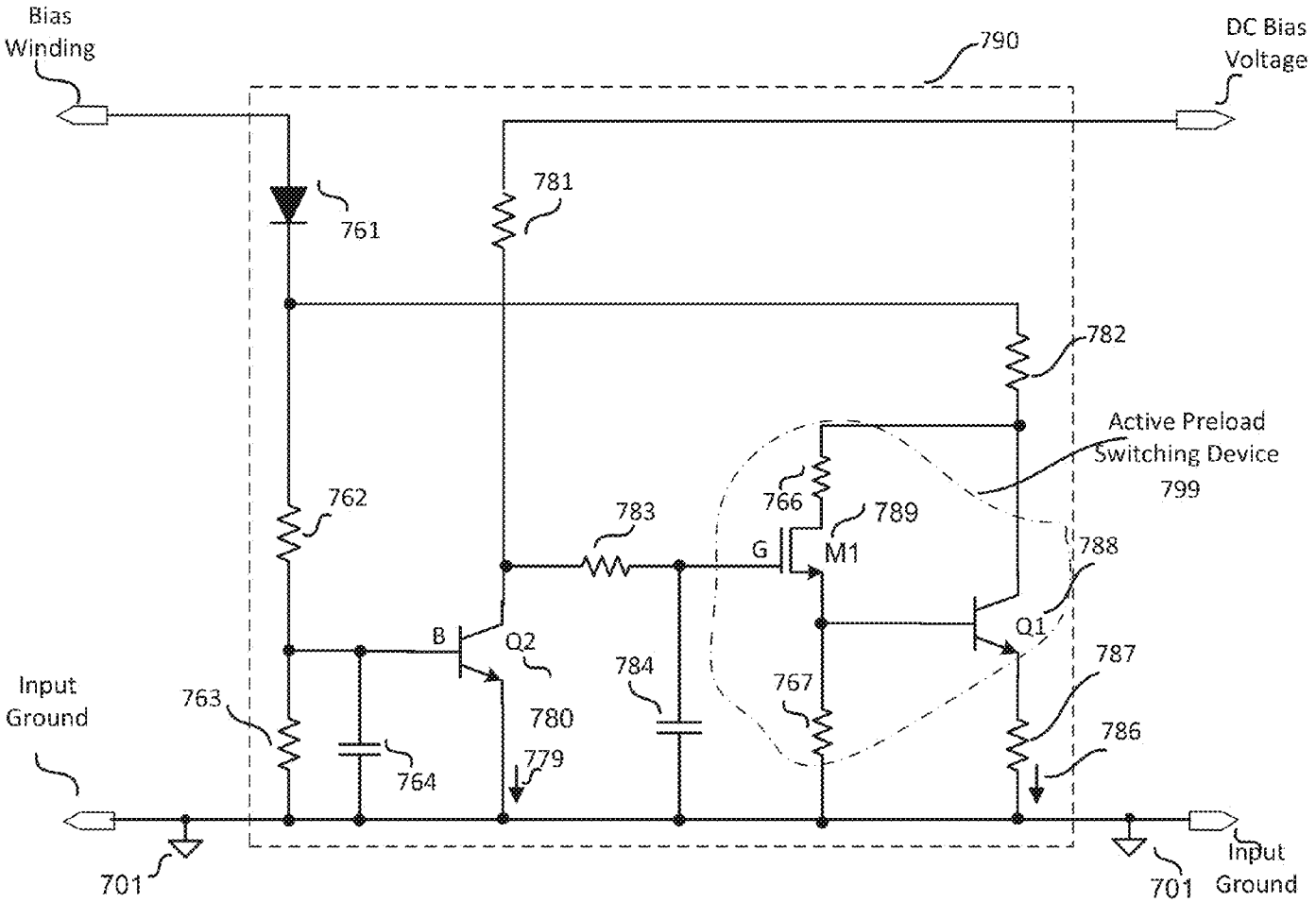
FIG. 7B is a schematic illustrating another example enhanced active preload implemented across the bias winding, referenced to input ground, and implemented with a preload switching module including a low power MOSFET cascaded with a BJT power transistor operating in linear mode.

FIG. 7B is a schematic illustrating another example enhanced active preload circuit 709 that is responsive to the input line conduction angle as indirectly sensed from the voltage across a bias winding. Enhanced active preload circuit 709 is similar to enhanced active preload circuit 700 of FIG. 7A, except that switching device M1, 785 of enhanced active preload circuit 700 is replaced with switching module 799. Switching module 799 may include resistor 767 and a cascaded combination of a low power transistor M1, 789 and a power transistor Q1, 788. It should be appreciated that in any of above examples, the enhanced active preload switching device may include a single or multiple coupled switches of different types and that none of illustrated examples are to be construed as restricting the implementation of the enhanced active preload.

During operation, enhanced active preload circuit 709 may sink current 786 through switching device Q1, 788 that, in one example, may include a BJT. Switching device Q1, 788 may receive a biasing signal at its control terminal from biasing circuitry (e.g., elements 761, 762, 763, 764, 766, 767, 780, 781, 783, 784, and 789), and may sink current 786 based on this biasing signal.

In FIG. 7B, the biasing signal from biasing transistor Q2, 780 (either in saturation switching mode or in linear mode) may be applied to the control terminal G of the low power transistor M1, 789 that operates in a linear mode. The current passing through transistor M1, 789 may pass through 766 and 767 to provide a biasing current for the power transistor Q1, 788 in linear mode, which may sink current that is inversely proportional to the conduction angle of input line phase controlled voltage.

Figure 7C:
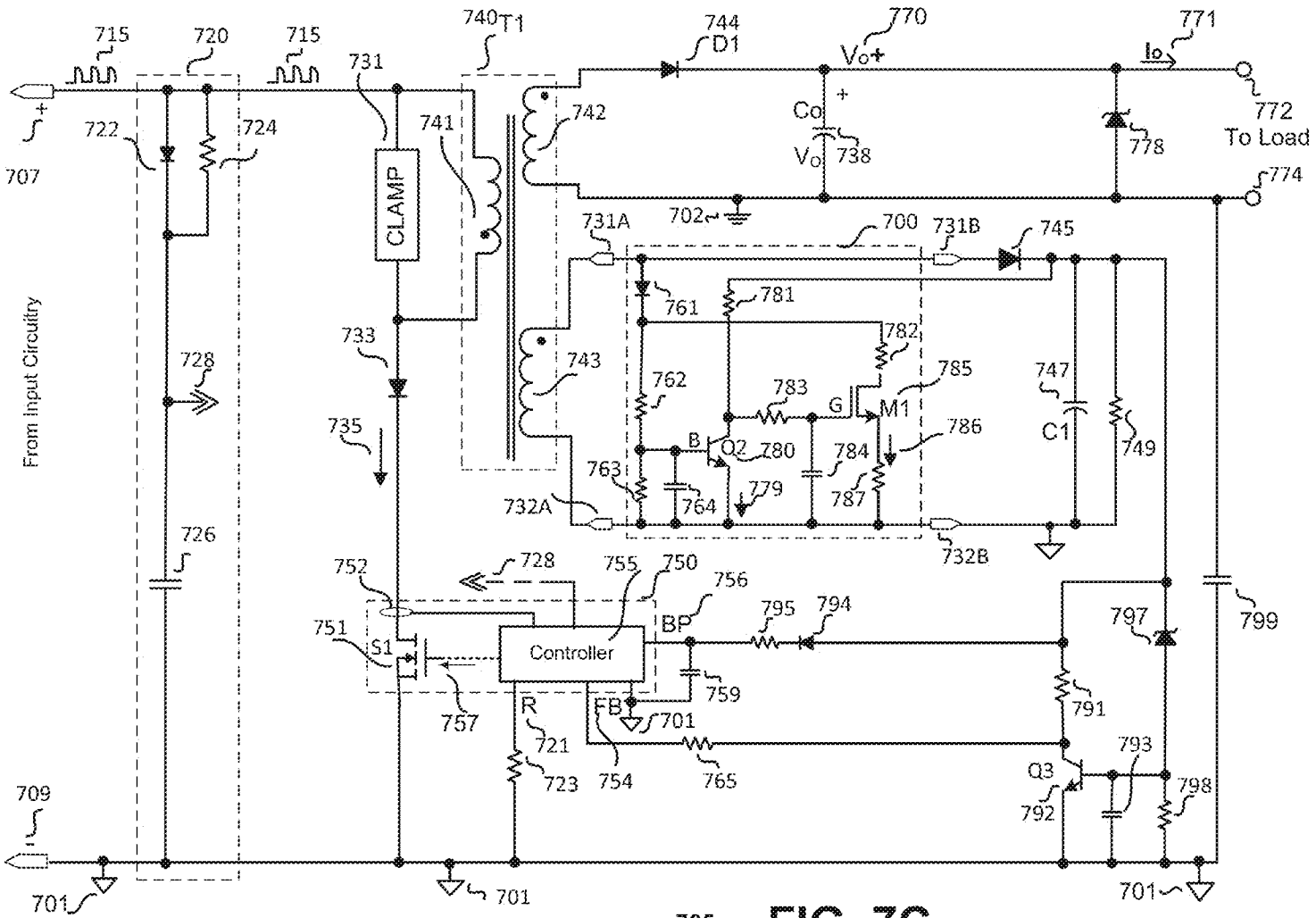
FIG. 7C is a schematic illustrating an example isolated Flyback LED driver converter implementing input line phase control dimming and having the enhanced active preload of FIG. 7A.

FIG. 7C is a schematic illustrating an example isolated Flyback LED driver converter 705 implementing input line phase control dimming and having the enhanced active preload 700 of FIG. 7A. The components and operation of Flyback LED driver converter 705 is similar to Flyback LED driver converter 405 of FIG. 4B, except that enhanced active preload 490 is replaced with enhanced active preload 700 and enhanced active preload 700 may be coupled across bias winding 743 rather than at the output load. To avoid repetition, a detailed discussion of Flyback LED driver converter 705 will be omitted and only a brief description will be provided.

Flyback LED driver converter 705 may receive a rectified leading edge phase controlled input voltage (represented by waveform $V_{RECT}$ 715 referenced to input ground 701) at input terminals 707/709. Flyback LED driver converter 705 may include peak detection circuit 720, which may include rectifier 722, resistor 724, and capacitor 726, and may generate input voltage signal 728. Flyback LED driver converter 705 may further include transformer T1, 740 having primary winding 741, secondary winding 742, and auxiliary (bias) winding 743.

An output voltage $V_O$, 770, referenced to output/secondary ground 702, and output current $I_O$, 771 may be applied to a load through rectifier 744 and output terminals 772 and 774. A bulk capacitor Co 738 and Zener diode 778 may be coupled across the load. Flyback regulated power converter 705 may optionally include capacitor 799 between input ground 701 and output ground 702.

Through rectifier diode 745, filter capacitor C1, 747, and resistor 749, auxiliary winding 743 may provide feedback information at feedback terminal FB, 754 (with transfer ratio of second and third windings) through resistor 791 and feedback resistor 765 and may provide a bias dc supply voltage to the supply terminal BP, 756 of controller 755. The bias dc supply voltage may be provided through a blocking diode 794 and an RC filter (resistor R, 795 and capacitor C, 759). Zener diode 797 at the dc output of auxiliary winding 743 may provide fast output transient over voltage protection by breaking down at an overshoot threshold, resulting in a bias voltage for transistor Q3, 792 across resistor 798 and capacitor 793 that causes transistor Q3, 792 to pull the voltage at the feedback terminal FB, 754 low to disable the controller drive signal 757.

Controller 755 may further include input terminals for receiving switch current 752 (representative of current 735) and input voltage signal 728, and a resistor detect terminal R, 721 coupled to an external selective resistor 723. Controller 755 may generate drive signal 757 to drive switching device S1, 751 and regulate the output. It should be appreciated that in some examples, controller 755 (and its individual components) and switching element S1, 751 may be implemented as a monolithic integrated circuit 750, may be implemented with discrete electrical components, or may be implemented in a combination of discrete components and integrated circuits.

Flyback LED driver converter 705 may further include clamp circuitry 731 coupled across primary winding 741 and optional diode 733 inserted as shown in FIG. 7C.

As shown in FIG. 7C, the enhanced active preload 700 may be coupled across the bias winding 743 to receive, at input terminals 731A/732A, the unfiltered voltage signal of bias winding 743 that is representative of the phase angle of the controlled input line voltage. Terminal 731B and 732B may be coupled to the bias supply output dc voltage (rectified/ filtered). Enhanced active preload circuit 700, as discussed above, may include transistor Q2, 780 operating in saturation (switch) mode or in linear (current source) mode to cause switching device M1, 785 to sink a current 786 in linear mode (as a current source) that is inversely proportional to the input line phase controlled voltage.

While FIG. 7C shows enhanced active preload circuit 700 in Flyback regulated power converter 705, enhanced active preload circuit 709 may similarly be used in other isolated or non-isolated LED driver topologies.

Figure 8A:
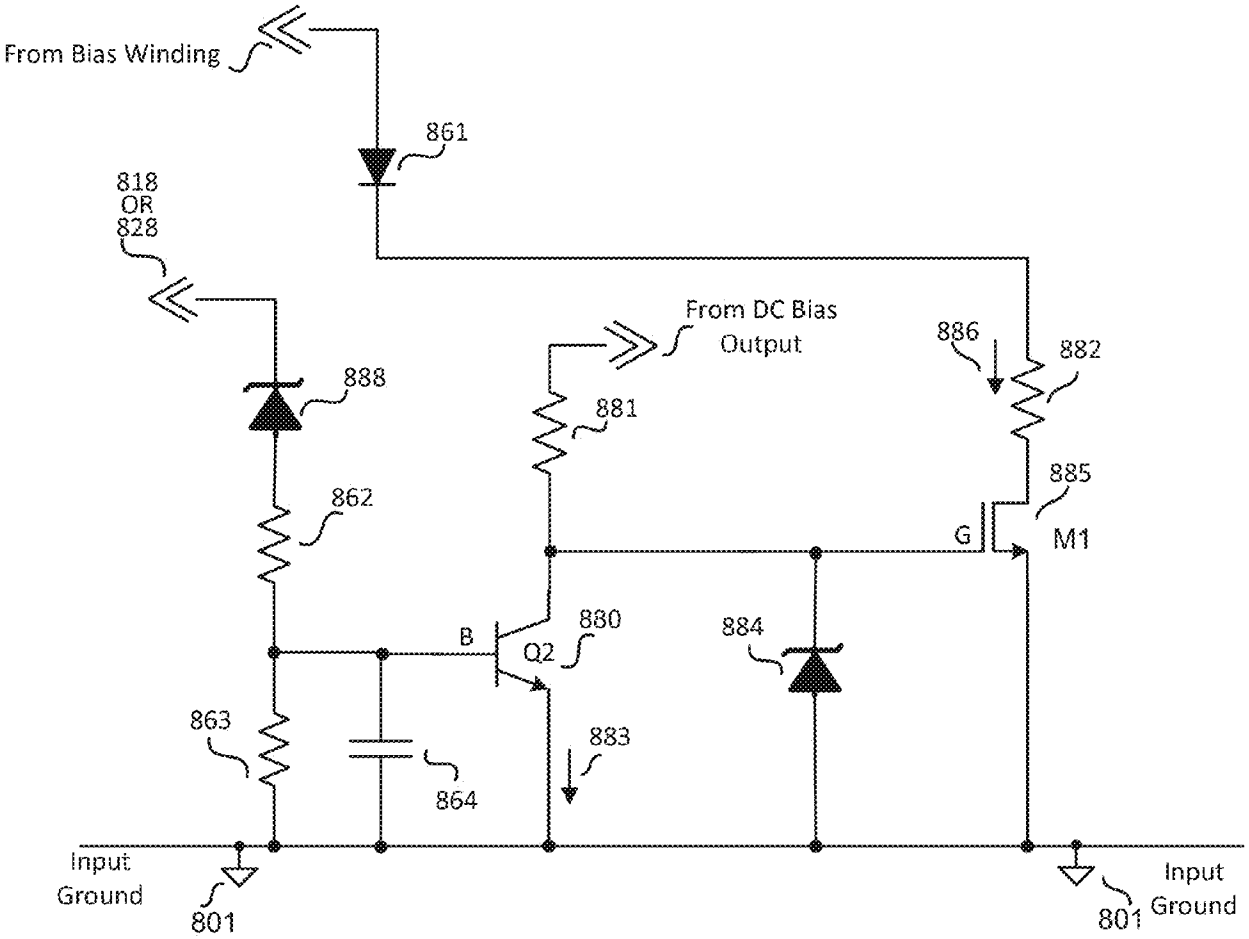
FIG. 8A is a schematic illustrating another example enhanced active preload circuit that may be implemented across the bias winding, referenced to input ground, and activated by a signal sensed at the input of an LED driver.

FIG. 8A is a schematic illustrating another example enhanced active preload circuit 800 that may be implemented across the bias winding, referenced to input ground, and activated by a signal sensed at the input of an LED driver. Enhanced active preload circuit 800 is an example preload circuit that may be used for any of enhanced active preload circuits 190, 290, or 390, discussed above.

Enhanced active preload circuit 800 may receive an input voltage peak signal or average detection at input signal (e.g., signal 818 or 828 in FIG. 8B) of a converter to activate the enhanced active preload circuit 800 to sink a current from the bias winding that is inversely proportional to the input line voltage conduction angle (e.g., at deep dimming, the enhanced active preload circuit 800 may be activated to sink more current 886 through the linear mode switching device M1, 885 of the active preload). Enhanced active preload circuit 800 may further receive input voltage signal 818 or 828 in response to average or peak value of the rectified and phase controlled input voltage. The input voltage signal 818 or 828 and the signals from the bias winding of a converter and from the bias dc output may be referenced to input ground 801.

In one example, when the input voltage signal 818 or 828 representing the Triac conduction angle (through average or peak detection) of the input voltage goes above a minimum threshold of Zener diode 888, the control terminal B of transistor Q2, 880 may be biased through resistors 862 and 863 and filter capacitor 864 in a linear mode. In the linear mode, the transistor Q2, 880 may sink a current 883 that is proportional to the conduction angle of the input voltage (e.g., Triac dimmer conduction angle). While the conduction angle is greater than a threshold value (e.g., >70°), transistor Q2, 880 may be in an ON state (e.g., acting as a short circuit) that results in the control terminal G of the switching device M1, 885 (e.g., an N-channel MOSFET in linear mode) being pulled low. Switching device M1, 885 may remain in an OFF state, thereby substantially preventing current 886 from being sank through resistor 882. This may result in little to no energy loss and higher efficiency at normal operation above the threshold conduction angle of the Triac dimmer.

When the conduction angle falls below the threshold (e.g., <70°), the bias at the control terminal B of transistor Q2, 880 may similarly reduce, resulting in operation of the transistor Q2, 880 in a linear mode in which it sinks a current from dc bias output through resistor 881 to input ground 801. The voltage drop on the transistor Q2, 880 in linear mode may be inversely proportional to the bias current 883 and with the leading edge peak of the input voltage. The voltage drop on the transistor Q2, 880 may apply a gating voltage on control terminal G of the switching device M1, 885 that may keep the switching device in a linear mode in which it sinks the preload current 886 through the preload resistor 882. The preload current 886 may be inversely proportional to the conduction angle of Triac dimmer as indirectly sensed using the average or leading edge peak of the input voltage as indicated by input voltage signal 818 or 828.

Enhanced active preload circuit 800 may further include Zener diode 884 at control terminal G of switching device M1, 885 to protect the transistor by limiting the gate voltage during conditions in which input voltage signal 818 or 828 is below a threshold value. Without Zener diode 884, the control terminal G of switching device M1, 885 may be pulled up to the dc bias voltage, which may exceed the gate rating voltage of switching device M1, 885. The active preload 800 consumes no power when input voltage signal 818 or 828 is below a threshold value that causes Zener diode 888 and transistor Q2, 880 to be in an OFF state.

Figure 8B:
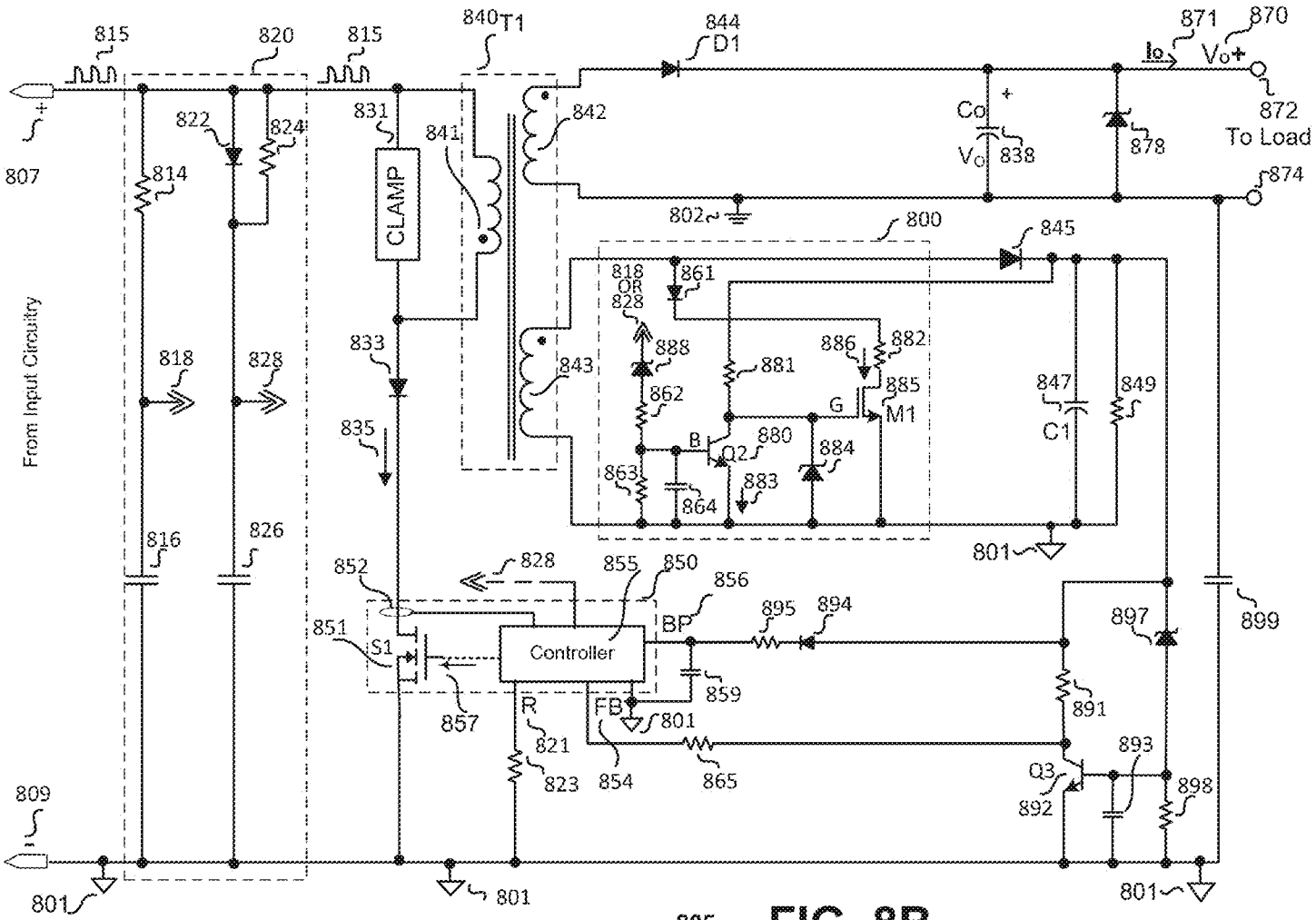
FIG. 8B is a schematic illustrating an example isolated Flyback LED driver converter implementing input line phase control dimming and having the enhanced active preload of FIG. 8A.

FIG. 8B is a schematic illustrating an example isolated Flyback LED driver converter 805 implementing input line phase control dimming and having the enhanced active preload 800 of FIG. 8A. The components and operation of Flyback LED driver converter 805 is similar to Flyback LED driver converter 705 of FIG. 7C, except that the enhanced active preload circuit of Flyback LED driver converter 805 may be further coupled to receive the input voltage signal 818 or 828 across capacitor 816 or 826 at input/primary side and the sensed signal 818 or 828 from average or peak detection circuit 820. To avoid repetition, a detailed discussion of Flyback LED driver converter 805 will be omitted and only a brief description will be provided.

Flyback LED driver converter 805 may receive a rectified leading edge phase controlled input voltage (represented by waveform $V_{RECT}$ 815 referenced to input ground 801) at input terminals 807/809. Flyback LED driver converter 805 may include peak detection circuit 820, which may include rectifier 822, resistor 824, and capacitor 826, and may generate input voltage signal 818 or 828. Flyback LED driver converter 805 may further include transformer T1, 840 having primary winding 841, secondary winding 842, and auxiliary winding 843.

An output voltage $V_O$, 870, referenced to output/secondary ground 802, and output current $I_O$, 871 may be applied to a load through rectifier 844 and output terminals 872 and 874. A bulk capacitor Co 838 and Zener diode 878 may be coupled across the load. Flyback regulated power converter 805 may optionally include capacitor 899 between input ground 801 and output ground 802.

Through rectifier diode 845, filter capacitor C1, 847, and resistor 849, auxiliary winding 843 may provide feedback information at feedback terminal FB, 854 (with transfer ratio of second and third windings) through resistor 891 and feedback resistor 865 and may provide a bias dc supply voltage to the supply terminal BP, 856 of controller 855. The bias dc supply voltage may be provided through a blocking diode 894 and an RC filter (resistor R, 895 and capacitor C, 859). Zener diode 897 at the dc output of auxiliary winding 843 may provide fast output transient over voltage protection by breaking down at an overshoot threshold, resulting in a bias voltage for transistor Q3, 892 across resistor 898 and capacitor 893 that causes transistor Q3, 892 to pull the voltage at the feedback terminal FB, 854 low to disable the controller drive signal 857.

Controller 855 may further include input terminals for receiving switch current 852 (representative of current 835) and input voltage signal 818 or 828, and a resistor detect terminal R, 821 coupled to an external selective resistor 823. Controller 855 may generate drive signal 857 to drive switching device S1, 851 and regulate the output. It should be appreciated that in some examples, controller 855 (and its individual components) and switching element S1, 851 may be implemented as a monolithic integrated circuit 850, may be implemented with discrete electrical components, or may be implemented in a combination of discrete components and integrated circuits.

Flyback LED driver converter 805 may further include clamp circuitry 831 coupled across primary winding 841 and optional diode 833 inserted as shown in FIG. 8B.

As shown in FIG. 8B, the enhanced active preload 800 may be coupled across the bias winding 843 to receive the unfiltered voltage signal of bias winding 843 that is representative of the phase angle of the controlled input line voltage. Enhanced active preload 800 may be further coupled to receive input voltage signal 818 or 828 and coupled to the bias supply output dc voltage (rectified/filtered).

As discussed above, when the input voltage signal 818 or 828 goes above a minimum threshold of Zener diode 888, transistor Q2, 880 may operate in a linear mode to sink a current that is proportional to the conduction angle of the input voltage (e.g., Triac dimmer conduction angle). When the input voltage signal 818 or 828 represents a conduction angle above a maximum threshold (e.g., >70°), transistor Q2, 880 may be in an ON state (e.g., acting as a short circuit), pulling down the control terminal G of the switching device M1, 885. When input voltage signal 818 or 828 represents a conduction angle below the maximum threshold (e.g., <70°), transistor Q2, 880 may again operate in a linear mode to sink current 883 from the dc bias output through resistor 881 to the input ground 801. The voltage drop across the transistor Q2, 880 in linear mode may be inversely proportional to its bias current and the leading edge peak or average of the input voltage as represented by input voltage signal 818 or 828. The voltage drop on the transistor Q2, 880 may apply a gating voltage on control terminal G of the switching device M1, 885 that may keep the switching device in a linear mode in which it sinks the preload current 886 through the preload resistor 882 and diode 861. The preload current 886 may be inversely proportional to the conduction angle of Triac dimmer as indirectly sensed using the leading edge peak of the input voltage as indicated by input voltage signal 818 or 828.

While the enhanced active preload circuits have been shown and described with respect to specific types of converters, it should be appreciated that the enhanced active preload circuits may be similarly used in any isolated or non-isolated power converter.

The above description of illustrated examples of the present invention, including what is described in the Abstract, are not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

These modifications can be made to examples of the invention in light of the above detailed description. The terms used in the following claims should not be construed to limit the invention to the specific embodiments disclosed in the specification and the claims. Rather, the scope is to be determined entirely by the following claims, which are to be construed in accordance with established doctrines of claim interpretation. The present specification and figures are accordingly to be regarded as illustrative rather than restrictive.

What is claimed is:

1. An active preload circuit configured to be coupled to an output of a light-emitting diode (LED) driver converter having a phase-angle control dimmer circuit, the active preload circuit comprising:

a biasing circuit coupled to receive a control signal representative of a conduction angle of the phase-angle control dimmer circuit, wherein the biasing circuit is configured to output a biasing signal; and a preload switching device coupled to receive the biasing signal, wherein the preload switching device is configured to operate in a linear mode as a current source to draw a variable sinking current, and wherein a value of the sinking current is based on the biasing signal.

2. The active preload circuit of claim 1, wherein the phase-angle control dimmer circuit comprises a leading edge control Triac dimmer.

3. The active preload circuit of claim 1, wherein the preload switching device is configured to cause the preload switching device to be in an ON state in response to the control signal indicating that the conduction angle has a value below a lower threshold amount.

4. The active preload circuit of claim 1, wherein the preload switching device is configured to be in an OFF state in response to the control signal indicating that the conduction angle has a value above an upper threshold amount.

5. The active preload circuit of claim 1, wherein the preload switching device is configured to cause the value of the sinking current to be inversely proportional to the conduction angle represented by the control signal when the control signal indicates that the conduction angle has a value above a lower threshold amount and below an upper threshold amount.

6. The active preload circuit of claim 1, wherein the control signal comprises a peak detect signal that is representative of a leading-edge peak voltage of an output of the phase-angle control dimmer circuit.

7. The active preload circuit of claim 6, wherein the biasing circuit comprises:

a bipolar junction transistor;

a first resistor coupled between a collector of the bipolar junction transistor and a bias voltage of the LED driver converter;

a first Zener diode coupled between the collector of the bipolar junction transistor and ground;

a capacitor coupled between a base of the bipolar junction transistor and ground;

a second resistor coupled between the base of the bipolar junction transistor and ground; and a third resistor coupled between the base of the bipolar junction transistor and an anode of a second Zener diode, wherein a cathode of the second Zener diode is coupled to receive the peak detect signal.

8. The active preload circuit of claim 1, wherein the control signal comprises a bias winding signal from a bias winding of the LED driver converter.

9. The active preload circuit of claim 8, wherein the biasing circuit comprises:

a bipolar junction transistor;

a first resistor coupled between a collector of the bipolar junction transistor and a bias voltage of the LED driver converter;

a second resistor coupled between the collector of the bipolar junction transistor and the preload switching device;

a first capacitor coupled between the second resistor, the preload switching device, and ground;

a second capacitor coupled between a base of the bipolar junction transistor and ground;

a third resistor coupled between the base of the bipolar junction transistor and ground; and a fourth resistor coupled between the base of the bipolar junction transistor and a cathode of a diode, wherein an anode of the diode is coupled to receive the bias winding signal.

10. The active preload circuit of claim 1, wherein the control signal comprises a secondary winding signal from a secondary winding of the LED driver converter.

11. The active preload circuit of claim 10, wherein the biasing circuit comprises:

a bipolar junction transistor;

a first resistor coupled between a collector of the bipolar junction transistor and a cathode of a first diode, wherein an anode of the first diode is coupled to receive the secondary winding signal;

a second resistor coupled between the collector of the bipolar junction transistor and the preload switching device;

a first capacitor coupled between the second resistor, the preload switching device, and ground;

a second capacitor coupled between a base of the bipolar junction transistor and ground;

a third resistor coupled between the base of the bipolar junction transistor and ground; and a fourth resistor coupled between the base of the bipolar junction transistor and a cathode of a second diode, wherein an anode of the second diode is coupled to receive the secondary winding signal.

12. The active preload circuit of claim 1, wherein the control signal comprises a load voltage of the LED driver converter.

13. The active preload circuit of claim 12, wherein the biasing circuit comprises:

a voltage regulator comprising an anode coupled to ground and a cathode coupled to a first resistor, wherein the first resistor is further coupled to the output of the LED driver converter;

a second resistor coupled between a reference terminal of the voltage regulator and the output of the LED driver converter;

a third resistor coupled between the reference terminal of the voltage regulator and ground;

a capacitor coupled between the cathode of the voltage regulator and ground;

a Zener diode coupled between the cathode of the voltage regulator and the preload switching device; and a fourth resistor coupled between an anode of the Zener diode and ground.

14. The active preload circuit of claim 1, wherein the control signal comprises a load current of the LED driver converter.

15. The active preload circuit of claim 14, wherein the biasing circuit comprises:

a bipolar junction transistor;

a first resistor coupled between a collector of the bipolar junction transistor and the output of the LED driver Converter;

a second resistor coupled between a base of the bipolar junction transistor and an anode of a Zener diode, wherein a cathode of the Zener diode is coupled to the output of the LED driver converter;

a capacitor coupled between the base of the bipolar junction transistor and ground;

a third resistor coupled between the base of the bipolar junction transistor and the output of the LED driver converter; and a fourth resistor coupled between the output of the led driver converter and ground, wherein the fourth resistor is coupled to receive the load current.

16. A light-emitting diode (led) driver comprising:

a phase-angle control dimmer circuit coupled to receive an input voltage and output a phase-adjusted voltage;

a rectifier circuit coupled to receive the phase-adjusted voltage and output a rectified voltage;

a converter coupled to receive the rectified voltage and output an output voltage;

an active preload circuit coupled to an output of the converter, wherein the active preload circuit comprises:

a biasing circuit coupled to receive a control signal representative of a conduction angle of the phase-angle control dimmer circuit, wherein the biasing circuit is configured to output a biasing signal; and a preload switching device coupled to receive the biasing signal, wherein the preload switching device is configured to operate in a linear mode as a current source to draw a variable sinking current, and wherein a value of the sinking current is based on the biasing signal.

17. The LED driver of claim 16, wherein the phase-angle control dimmer circuit comprises a leading edge control Triac dimmer.

18. The led driver of claim 16, wherein the preload switching device is configured to cause the preload switching device to be in an ON state in response to the control signal indicating that the conduction angle has a value below a lower threshold amount.

19. The LED driver of claim 16, wherein the preload switching device is configured to be in an OFF state in response to the control signal indicating that the conduction angle has a value above an upper threshold amount.

20. The led driver of claim 16, further comprising an LED coupled to the enhanced active preload.

* * * * *